US008104803B2

(12) United States Patent
Horton et al.

(10) Patent No.: US 8,104,803 B2
(45) Date of Patent: Jan. 31, 2012

(54) ROTARY PAWL LATCH AND ROCKER SWITCH

(75) Inventors: Richard Horton, Stourbridge (GB); Andrew Thornton, Kingswinford (GB)

(73) Assignee: Southco, Inc., Concordville, PA (US)

( * ) Notice: Subject to any disclaimer, the term of this patent is extended or adjusted under 35 U.S.C. 154(b) by 1082 days.

(21) Appl. No.: 11/817,744

(22) PCT Filed: Mar. 4, 2006

(86) PCT No.: PCT/US2006/007843

§ 371 (c)(1),
(2), (4) Date: Sep. 4, 2007

(87) PCT Pub. No.: WO2006/096600

PCT Pub. Date: Sep. 14, 2006

(65) Prior Publication Data

US 2008/0169657 A1 Jul. 17, 2008

Related U.S. Application Data

(60) Provisional application No. 60/658,849, filed on Mar. 5, 2005.

(51) Int. Cl.
*E05C 3/06* (2006.01)
*H01H 3/00* (2006.01)

(52) U.S. Cl. ..... 292/201; 292/207; 292/DIG. 37; 200/339

(58) Field of Classification Search ..... 292/201, 292/207, DIG. 37; 220/339; 200/339
See application file for complete search history.

(56) References Cited

U.S. PATENT DOCUMENTS

| | | | | |
|---|---|---|---|---|
| 745,042 | A | 11/1903 | Daves | |
| 2,910,859 | A * | 11/1959 | Allen et al. | 70/135 |
| 2,941,047 | A * | 6/1960 | Grashoff | 200/4 |
| 3,325,203 | A * | 6/1967 | Moler | 292/201 |
| 3,924,427 | A * | 12/1975 | San Juaquin | 70/264 |
| 4,045,650 | A * | 8/1977 | Nestor | 200/556 |
| 4,135,377 | A | 1/1979 | Kleefeldt et al. | |
| 4,208,837 | A | 6/1980 | Black, Sr. et al. | |
| 4,268,076 | A | 5/1981 | Itoi | |
| 4,401,864 | A * | 8/1983 | Ichikawa | 200/17 R |

(Continued)

FOREIGN PATENT DOCUMENTS

| | | |
|---|---|---|
| DE | 201390 | 8/1907 |

(Continued)

OTHER PUBLICATIONS

TrMark Website print out—www.trimarkcorp.com, 050-0410 Floating Striker Single Rotor Latch Single Position, 19 pages. Printed out on Apr. 13, 2004.

(Continued)

*Primary Examiner* — Carlos Lugo
(74) *Attorney, Agent, or Firm* — Paul & Paul

(57) ABSTRACT

A latching system for securing two members together includes a housing, a pawl that is pivotally attached to the housing, a locking member, an actuating mechanism, and a rocker switch. The pawl is movable between a closed configuration and an open configuration. The rocker switch is used to control the actuating mechanism. The rocker switch includes an outer housing, an inner housing, a printed circuit board, and a button. The pawl is provided with a torsion spring member that biases the pawl toward the open or disengaged configuration. Energizing the electrical actuating mechanism retracts the locking member out of engagement with the pawl, thus allowing the pawl to rotate under spring bias to the open configuration.

12 Claims, 53 Drawing Sheets

U.S. PATENT DOCUMENTS

| | | | | |
|---|---|---|---|---|
| 4,429,200 | A * | 1/1984 | Glenn et al. | 200/332.1 |
| 4,438,964 | A * | 3/1984 | Peters | 292/216 |
| 4,551,660 | A * | 11/1985 | Suzuki | 318/293 |
| 4,620,071 | A * | 10/1986 | Rushansky | 200/6 BA |
| 4,691,584 | A * | 9/1987 | Takaishi et al. | 74/471 R |
| 4,691,948 | A * | 9/1987 | Austin et al. | 292/171 |
| 4,867,496 | A | 9/1989 | Thomas | |
| 4,973,091 | A | 11/1990 | Paulson et al. | |
| 5,198,283 | A * | 3/1993 | Hausler et al. | 428/195.1 |
| 5,484,178 | A | 1/1996 | Sandhu et al. | |
| 5,504,286 | A * | 4/1996 | Tsai | 200/5 R |
| 5,508,479 | A | 4/1996 | Schooley | |
| 5,642,806 | A | 7/1997 | Karadimas | |
| 5,803,243 | A | 9/1998 | Nestor et al. | |
| 5,823,026 | A * | 10/1998 | Finke | 70/276 |
| 5,927,772 | A | 7/1999 | Antonucci et al. | |
| 6,139,073 | A | 10/2000 | Heffner et al. | |
| 6,155,616 | A * | 12/2000 | Akright | 292/207 |
| 6,164,711 | A | 12/2000 | Neal et al. | |
| 6,375,577 | B1 | 4/2002 | Smith et al. | |
| 6,386,599 | B1 | 5/2002 | Chevalier | |
| 6,575,503 | B1 * | 6/2003 | Johansson et al. | 292/170 |
| 6,576,855 | B2 | 6/2003 | Levendis et al. | |
| 6,659,515 | B2 | 12/2003 | Raymond et al. | |
| 6,705,140 | B1 | 3/2004 | Dimig et al. | |
| 6,713,693 | B1 | 3/2004 | Sadowski et al. | |
| 6,861,594 | B2 | 3/2005 | Sadowski et al. | |
| 6,948,745 | B2 | 9/2005 | Chevalier | |
| 7,004,517 | B2 * | 2/2006 | Vitry et al. | 292/213 |
| 7,296,830 | B2 * | 11/2007 | Koveal et al. | 292/201 |
| 7,306,266 | B2 * | 12/2007 | Hapke et al. | 292/218 |
| 7,461,872 | B2 * | 12/2008 | Moon et al. | 292/209 |
| 7,521,642 | B2 * | 4/2009 | Belanger | 200/339 |
| 7,681,424 | B2 * | 3/2010 | Antonucci | 70/208 |
| 2003/0094024 | A1 | 5/2003 | Dimig | |
| 2005/0067840 | A1 | 3/2005 | Koveal et al. | |

FOREIGN PATENT DOCUMENTS

| | | | |
|---|---|---|---|
| DE | 355578 | | 6/1922 |
| DE | 538812 | | 11/1931 |
| DE | 685943 | | 12/1939 |
| DE | 4129706 | A1 | 11/1993 |
| DE | 19527565 | A1 | 1/1997 |
| EP | 0169644 | A2 | 1/1986 |
| EP | 0285412 | A2 | 5/1988 |
| EP | 0694665 | A1 | 1/1996 |
| EP | 0743413 | A1 | 11/1996 |
| FR | 2746840 | A1 | 10/1997 |
| GB | 5427 | | 1/1912 |
| GB | 1563368 | | 3/1980 |
| GB | 2034801 | A | 6/1980 |
| GB | 2252351 | A | 8/1992 |
| GB | 2257745 | A | 1/1993 |
| GB | 2277958 | A | 11/1994 |
| IT | 416367 | | 5/1946 |
| WO | WO9005822 | | 5/1990 |
| WO | WO0020710 | A1 | 4/2000 |
| WO | WO2006096600 | A2 | 9/2006 |

OTHER PUBLICATIONS

Tech-Train Bulletin—Steven E. Young, Issue #16, 2002, 3 pages.

* cited by examiner

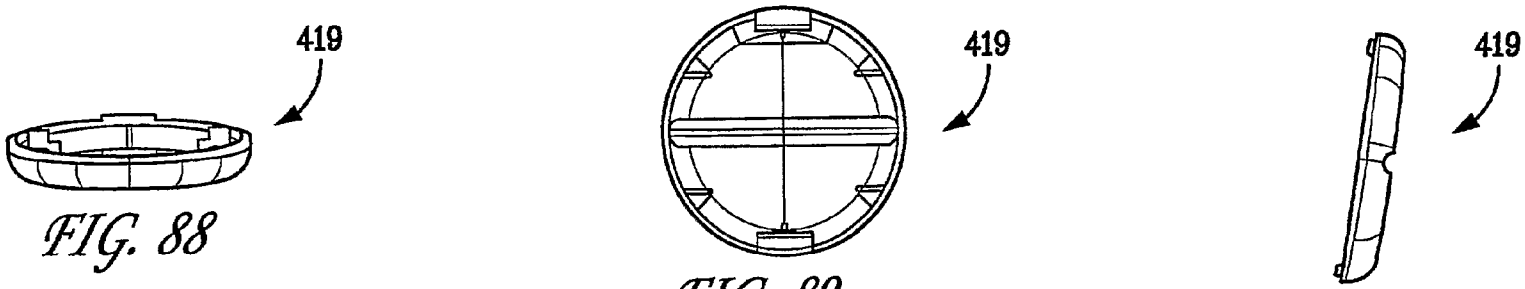
FIG. 88
FIG. 89
FIG. 90
FIG. 91
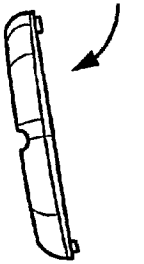
FIG. 92
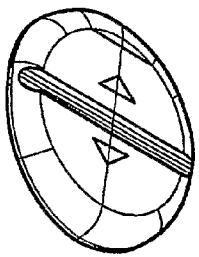
FIG. 93
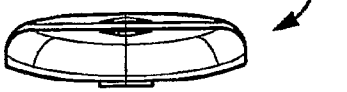
FIG. 94

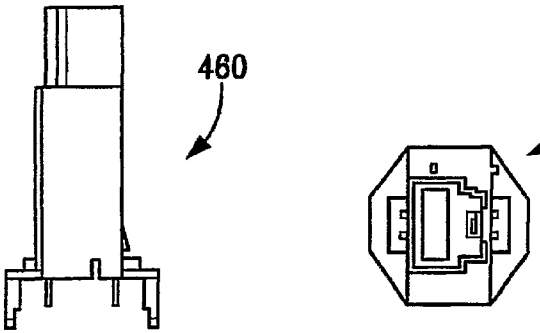
FIG. 109
FIG. 110
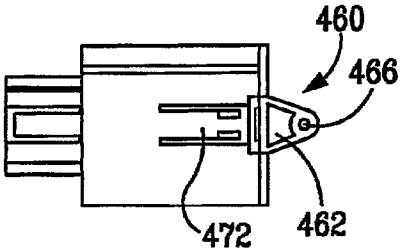
FIG. 111
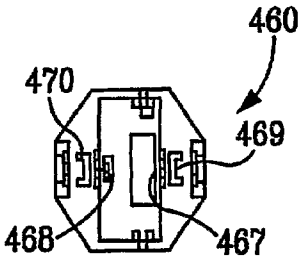
FIG. 112
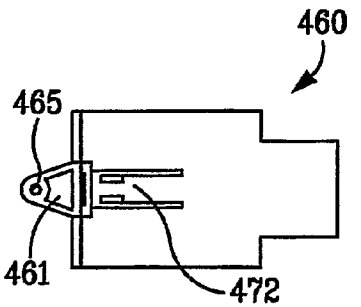
FIG. 113
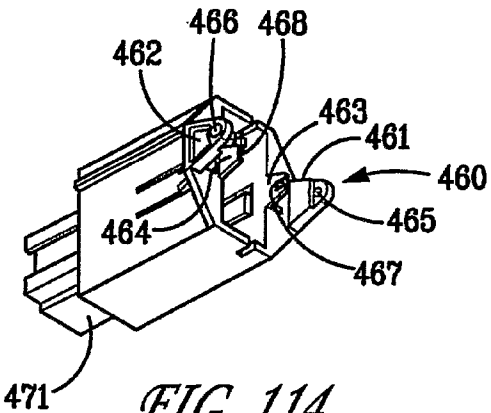
FIG. 114
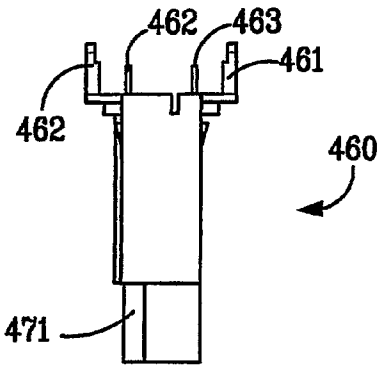
FIG. 115

ROTARY PAWL LATCH AND ROCKER SWITCH

BACKGROUND OF THE INVENTION

1. Field of Invention

The present invention relates to the field of latch assemblies.

2. Brief Description of the Related Art

Latch assemblies are relied on in many applications for securing items, such as panels, doors, and doorframes together. For example, containers, cabinets, closets, compartments and the like may be secured with a latch. An important use for latches is in the automotive field, where there is a desire and need to access automotive compartments, such as, for example, the trunk or passenger compartments of vehicles, as well as interior compartments such as a glove box. Various latches for panel closures have been employed where one of the panels such as a swinging door or the like is to be fastened or secured to a stationary panel, doorframe, or compartment body. Although many latch assemblies are known in the prior art, none are seen to teach or suggest the unique features of the present invention or to achieve the advantages of the present invention.

SUMMARY OF THE INVENTION

The present invention is directed to a latching system for securing two members together. The present invention includes a housing, a pawl that is pivotally attached to the housing, a locking member and an actuating mechanism. The pawl is movable between a closed or engaged configuration and an open or disengaged configuration. The pawl is provided with a torsion spring member that biases the pawl toward the open or disengaged configuration. The locking member is supported for rotational movement by the housing. The locking member is movable between an extended position and a retracted position and is spring biased toward the extended position. The locking member can be retracted by the action of the actuating mechanism. When the pawl strikes a keeper during closing, the pawl is moved to the closed configuration. A lug projecting from the pawl is engaged by the locking member once the pawl is in the closed configuration in order to keep the pawl in the closed configuration. At this time the pawl captures the keeper to secure the latch to the keeper. The actuating mechanism is used to selectively retract the locking member in order to disengage the locking member from the pawl, which allows the pawl to rotate under the force of the torsion spring to the open configuration. Thus, the latch can be disengaged from the keeper and a compartment, for example, can be opened.

In a first embodiment, the housing that supports the pawl also supports the actuating mechanism. In a second embodiment, the actuating mechanism is located remotely relative to the housing that supports the pawl, and a cable is used to link the actuating mechanism with the locking member.

The invention also includes a rocker switch that can be used to control the actuating mechanism when the actuating mechanism is electrically powered.

BRIEF DESCRIPTION OF THE DRAWINGS

FIGS. 88-94 are views of the faceplate of the rocker switch button of a rocker switch assembly in accordance with the present invention.

FIGS. 109-115 are views of the inner housing of a rocker switch assembly in accordance with the present invention.

Figure 3:
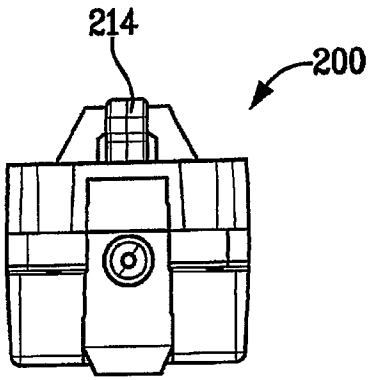
FIGS. 1-8 are views of a latch assembly in accordance with the first embodiment of the present invention.
Figure 1:
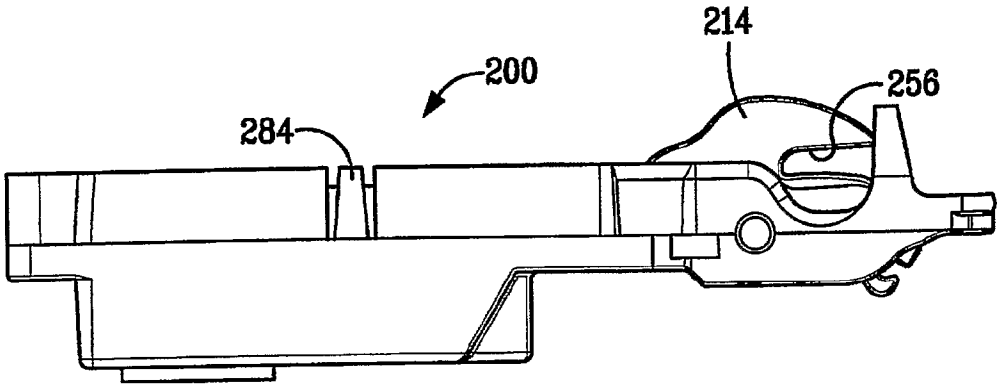
Figure 2:
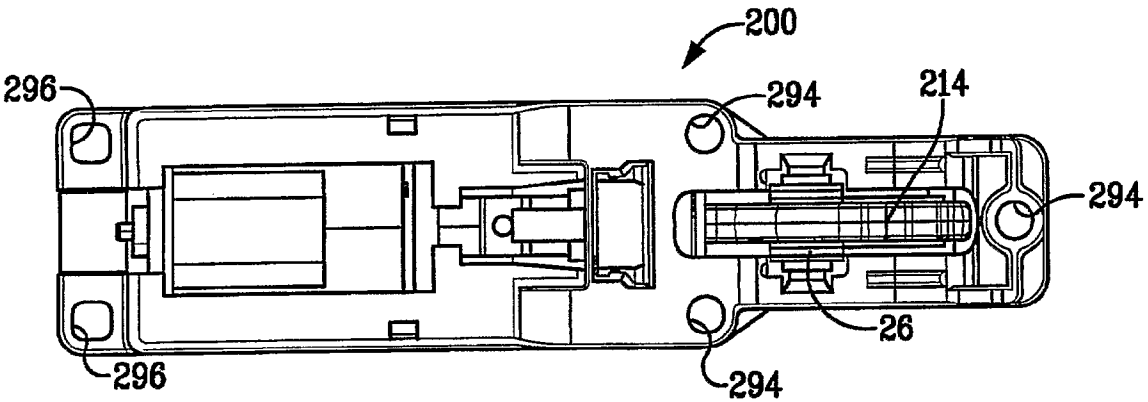
Figure 6:
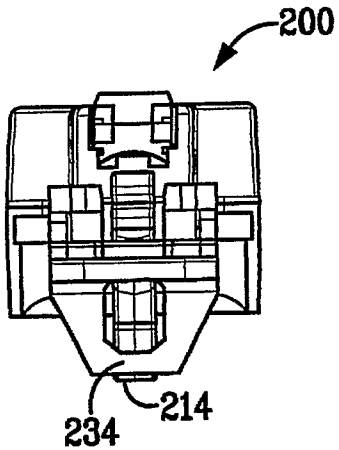
Figure 4:
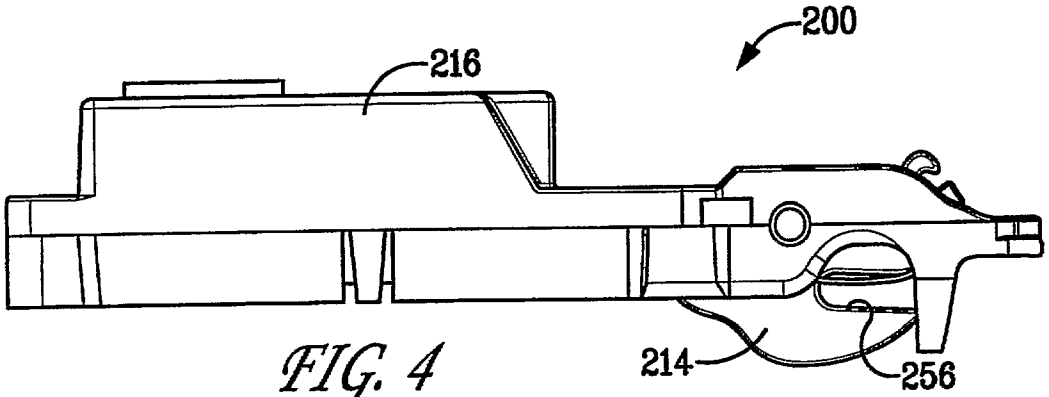
Figure 5:
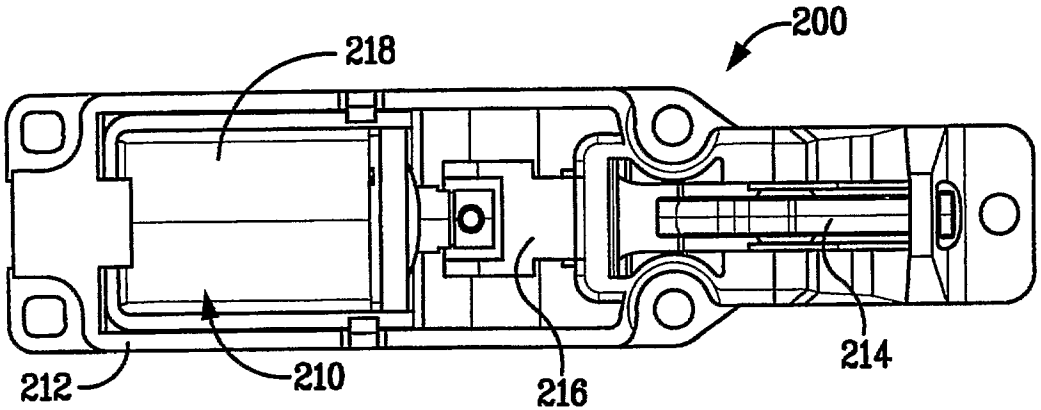
Figure 7:
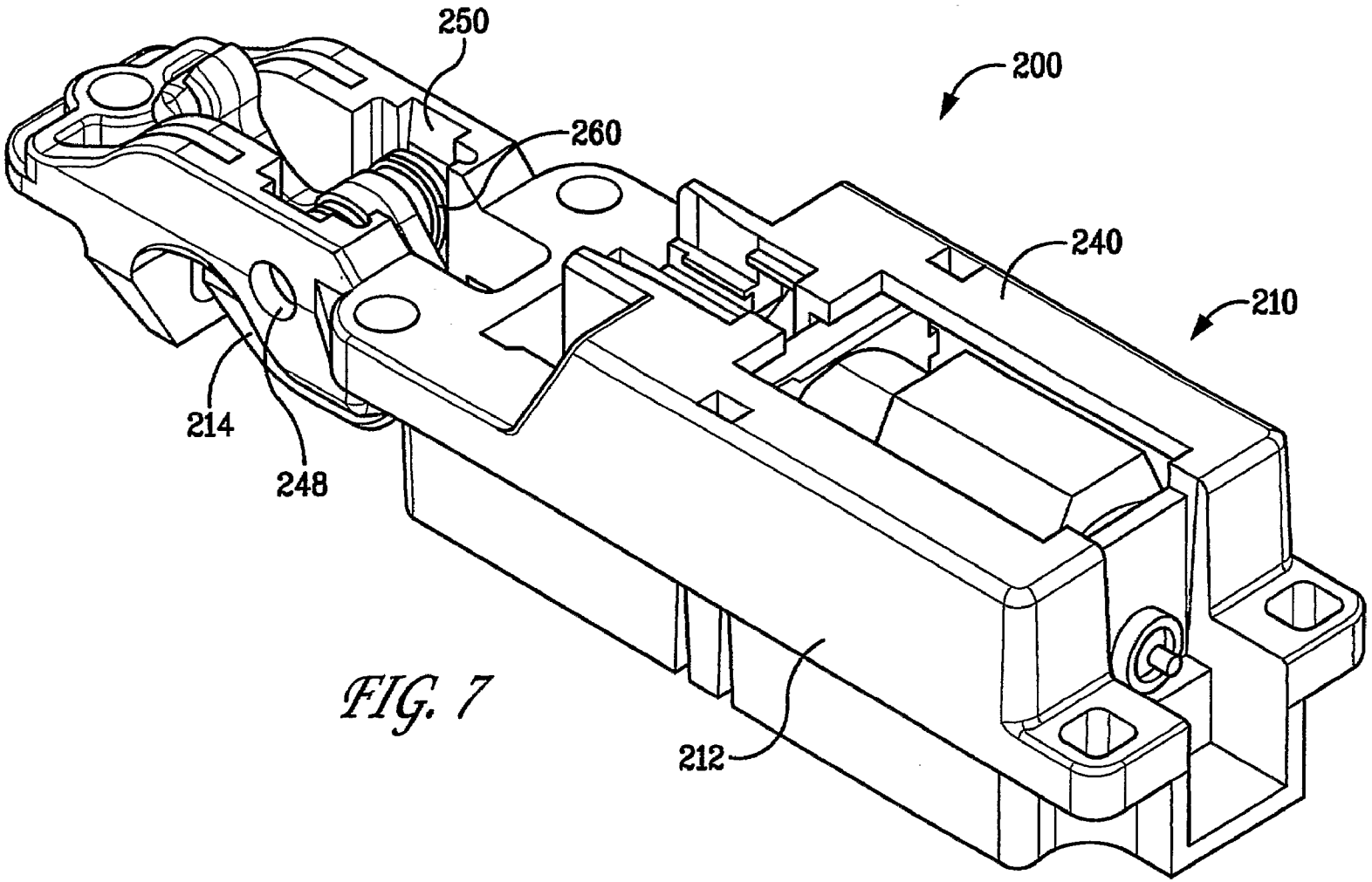
Figure 8:
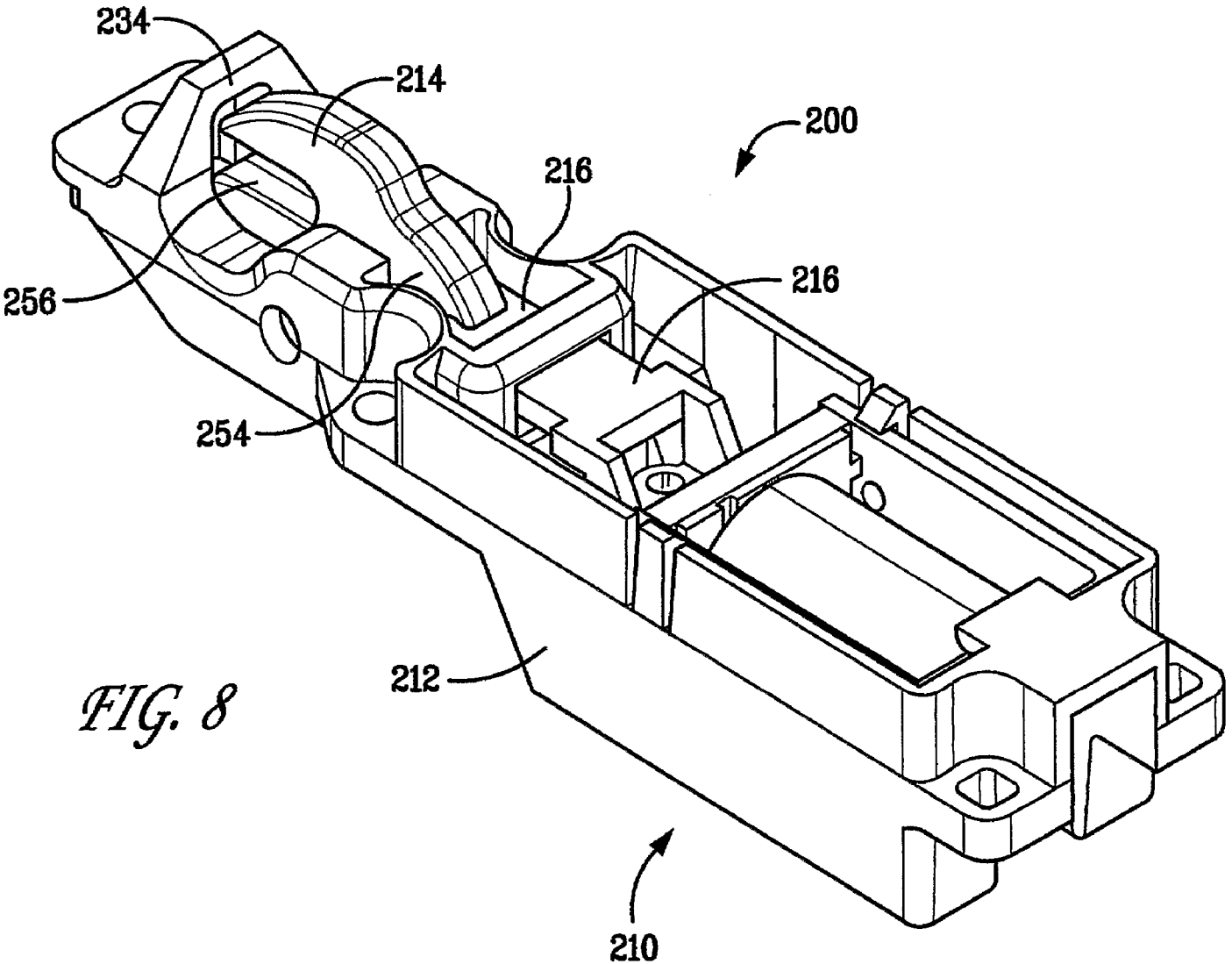
Figure 9:
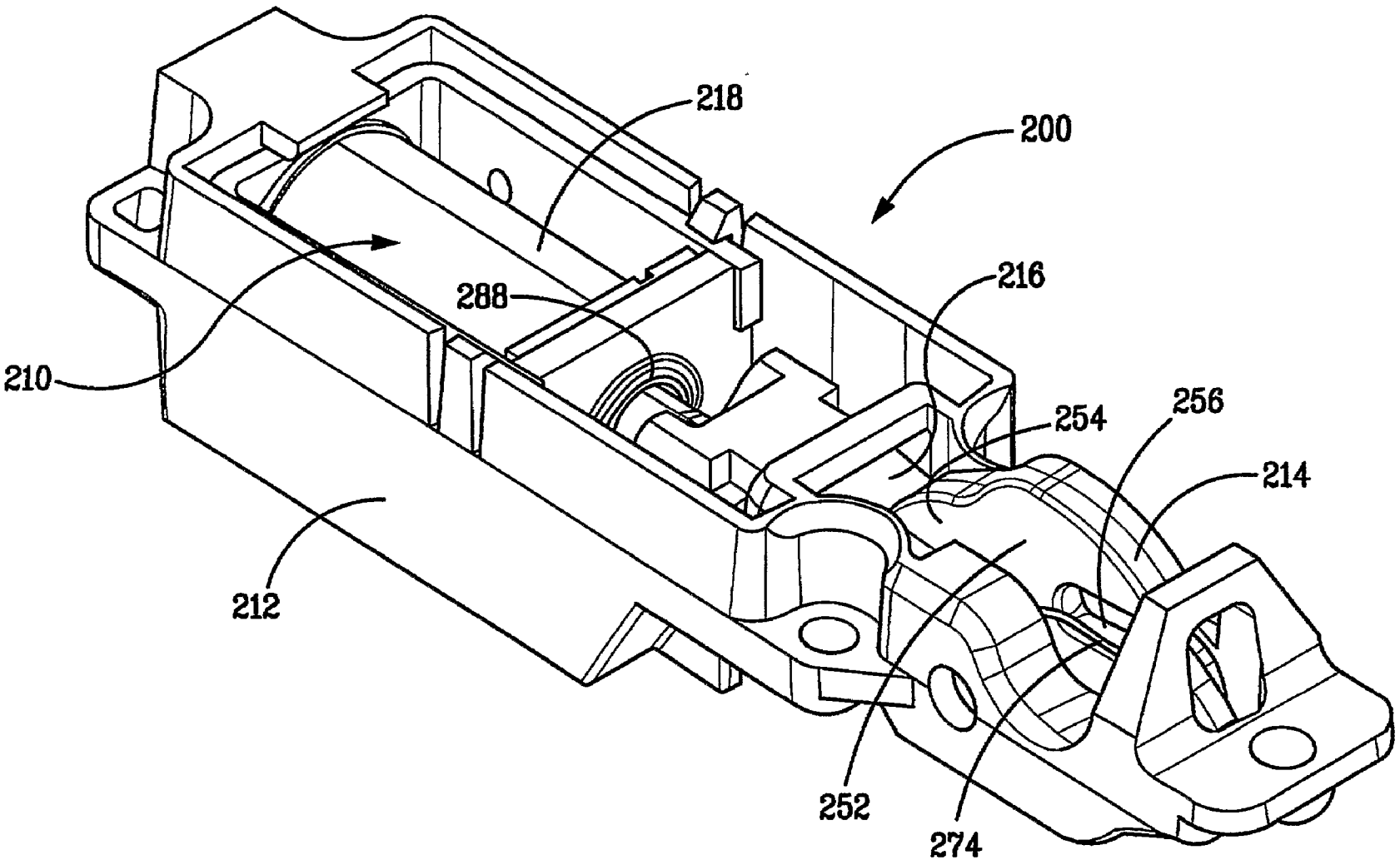
FIG. 9 is an isometric view showing the latch assembly in accordance with the first embodiment of the present invention in the closed position.
Figure 10:
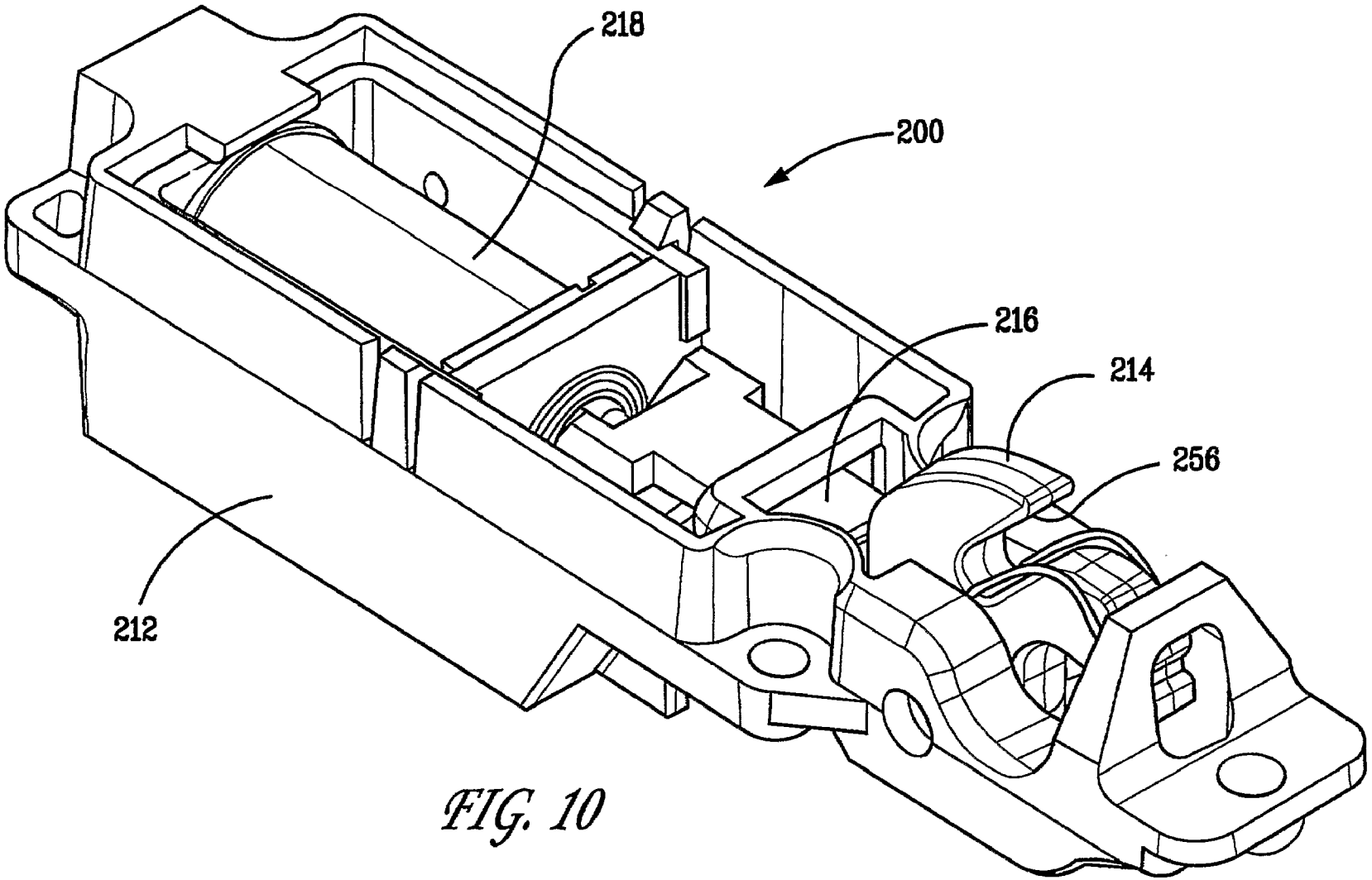
FIG. 10 is an isometric view showing the latch assembly in accordance with the first embodiment of the present invention in the open position.
Figure 11:
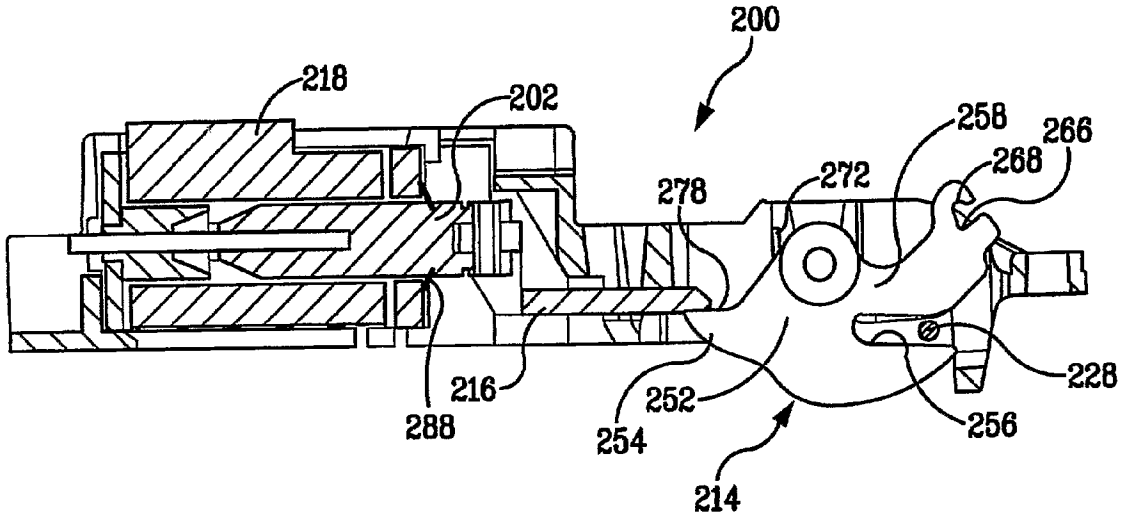
FIG. 11 is a cross sectional view showing the latch assembly in accordance with the first embodiment of the present invention in the closed position.
Figure 12:
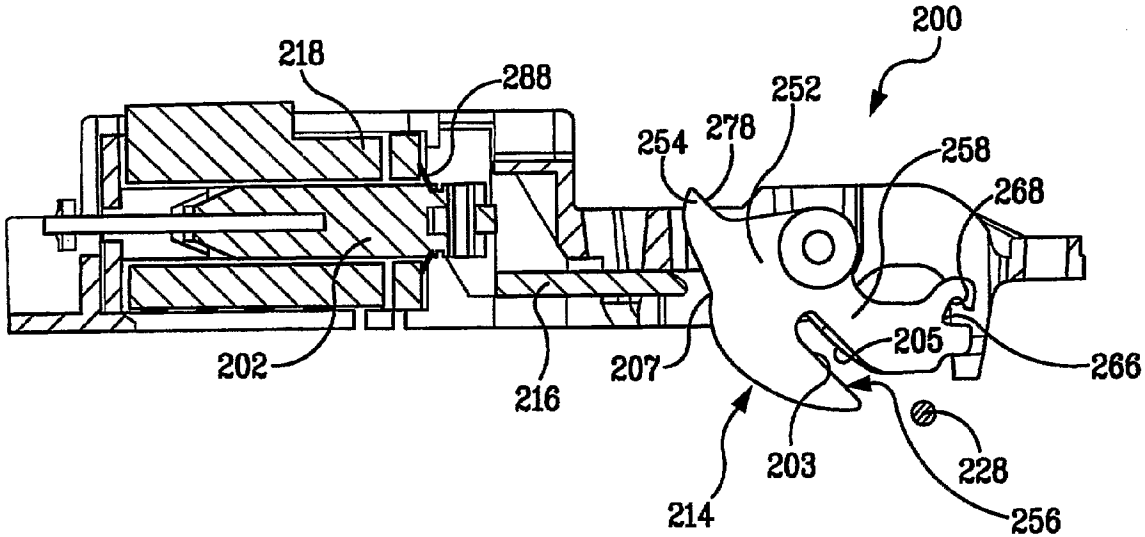
FIG. 12 is a cross sectional view showing the latch assembly in accordance with the first embodiment of the present invention in the open position.
Figure 13:
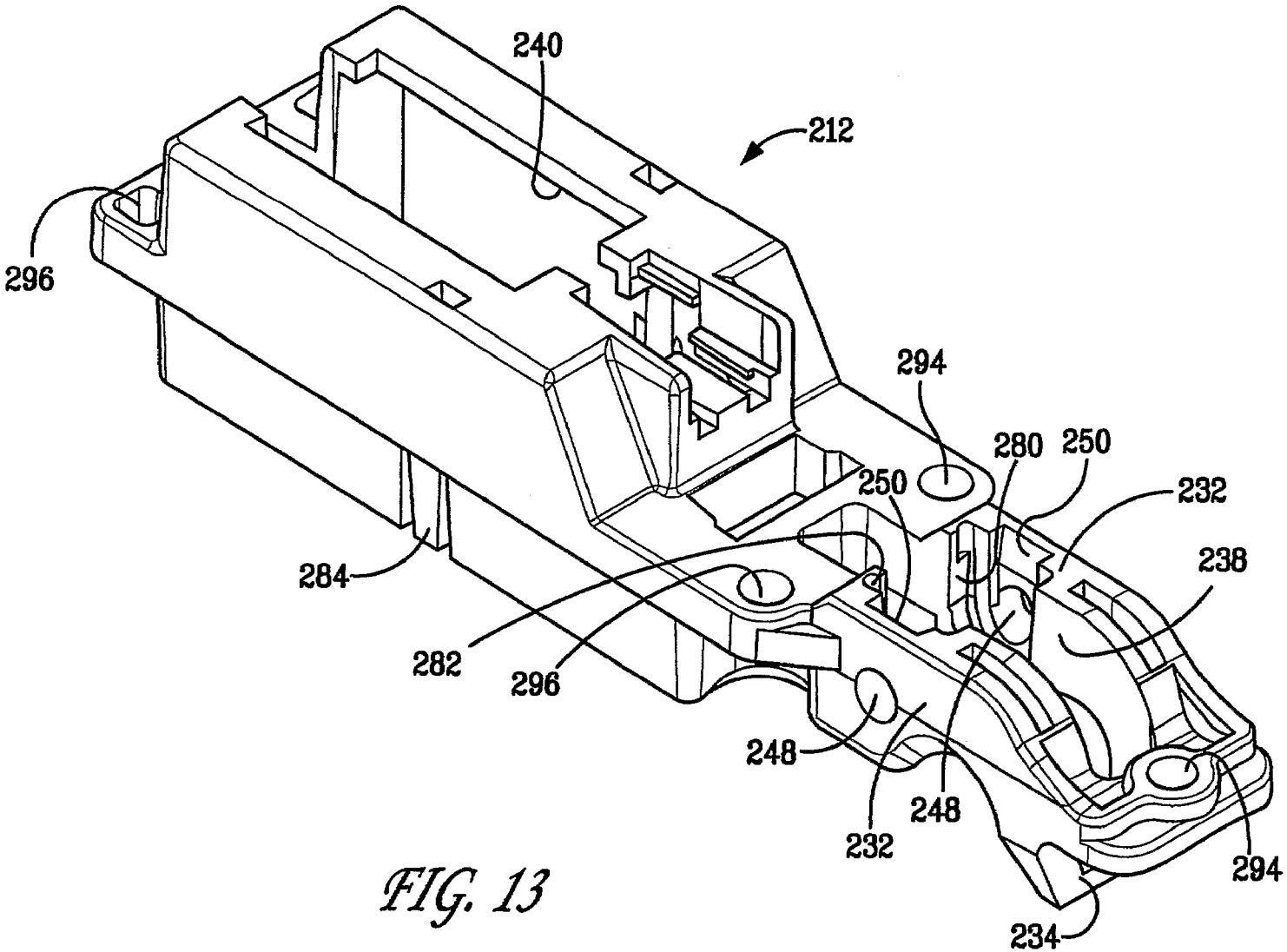
FIGS. 13-19 are views of the housing of the latch assembly in accordance with the first embodiment of the present invention.
Figure 16:
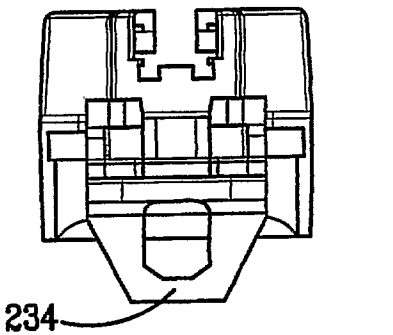
Figure 14:
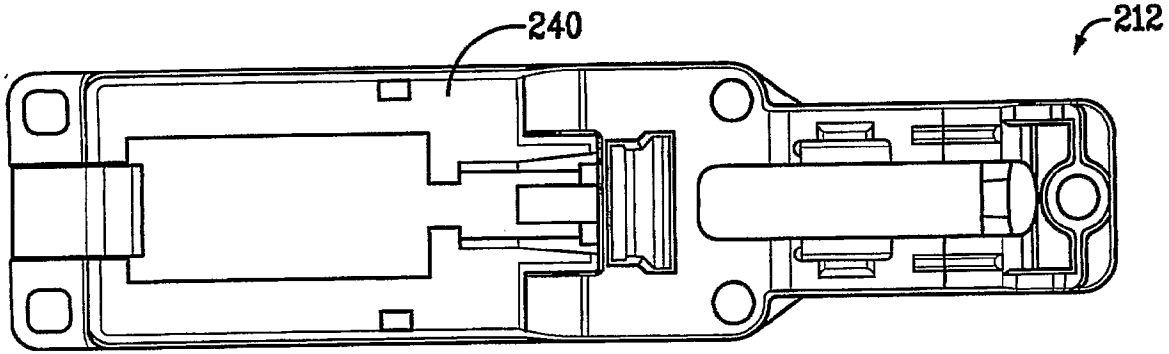
Figure 15:
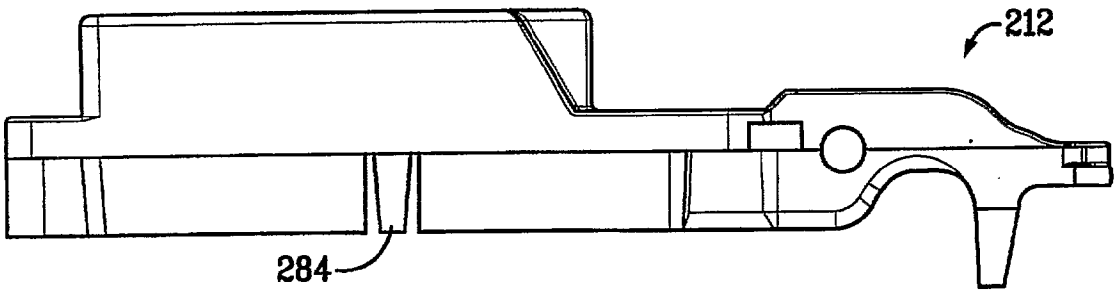
Figure 17:
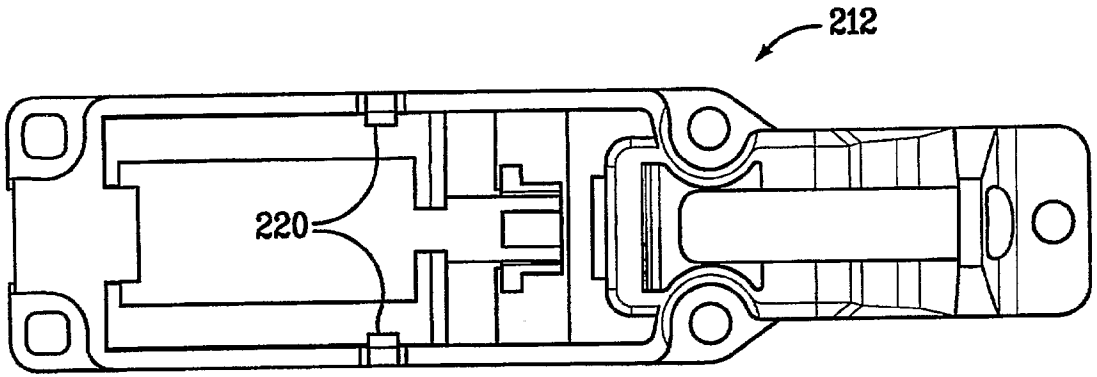
Figure 19:
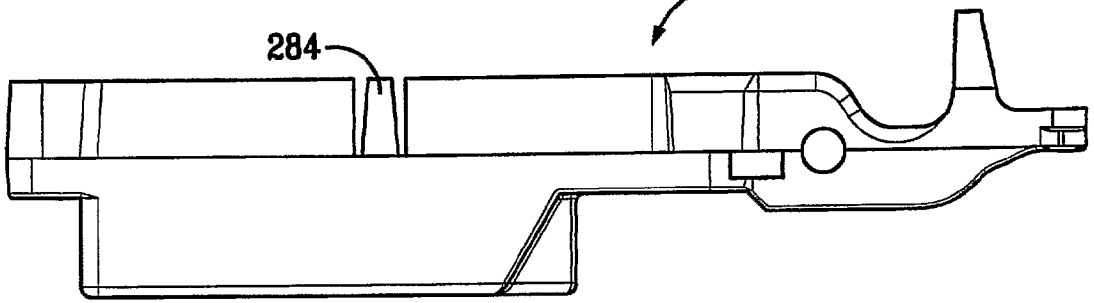
Figure 18:
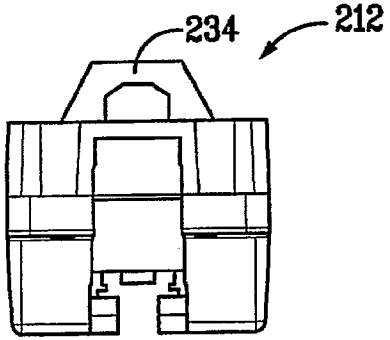
Figure 22:
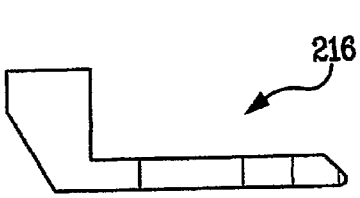
FIGS. 20-26 are views of the locking member of the latch assembly in accordance with the first embodiment of the present invention.
Figure 21:
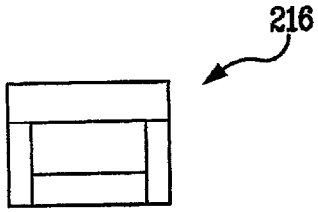
Figure 24:
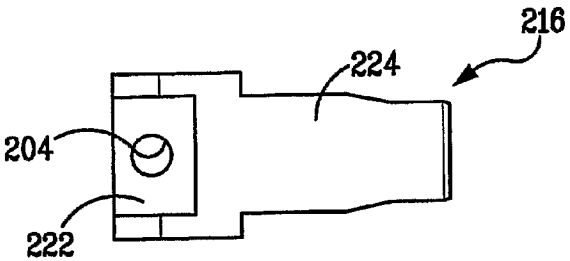
Figure 26:
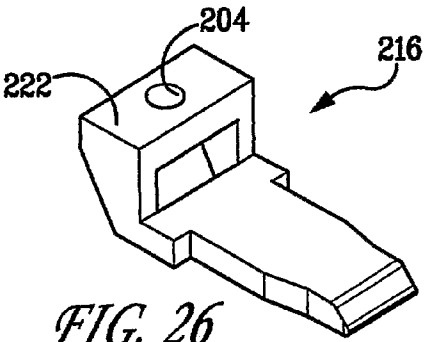
Figure 20:
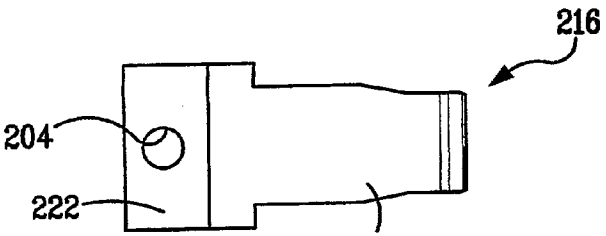
Figure 23:
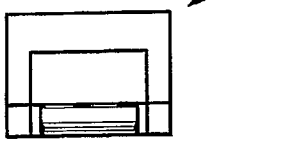
Figure 25:
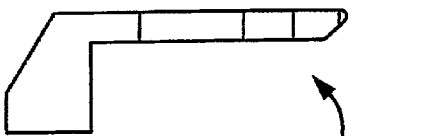
Figure 28:
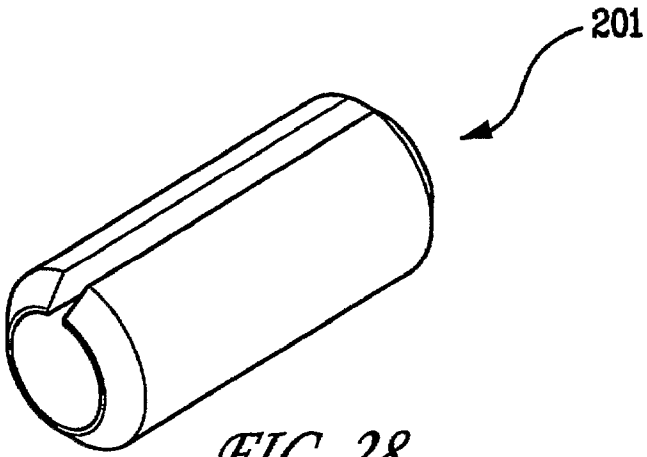
FIGS. 27-30 are views of the attachment pin used for attaching the locking member to the actuating mechanism of the latch assembly in accordance with the first embodiment of the present invention.
Figure 30:
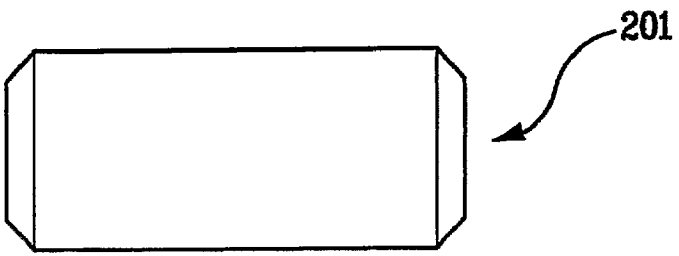
Figure 27:
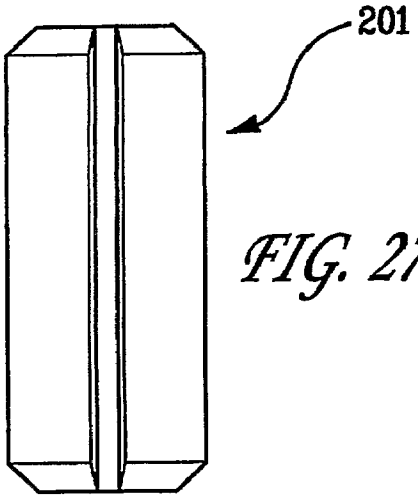
Figure 29:
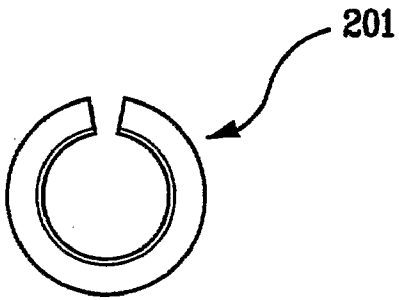
Figure 31:
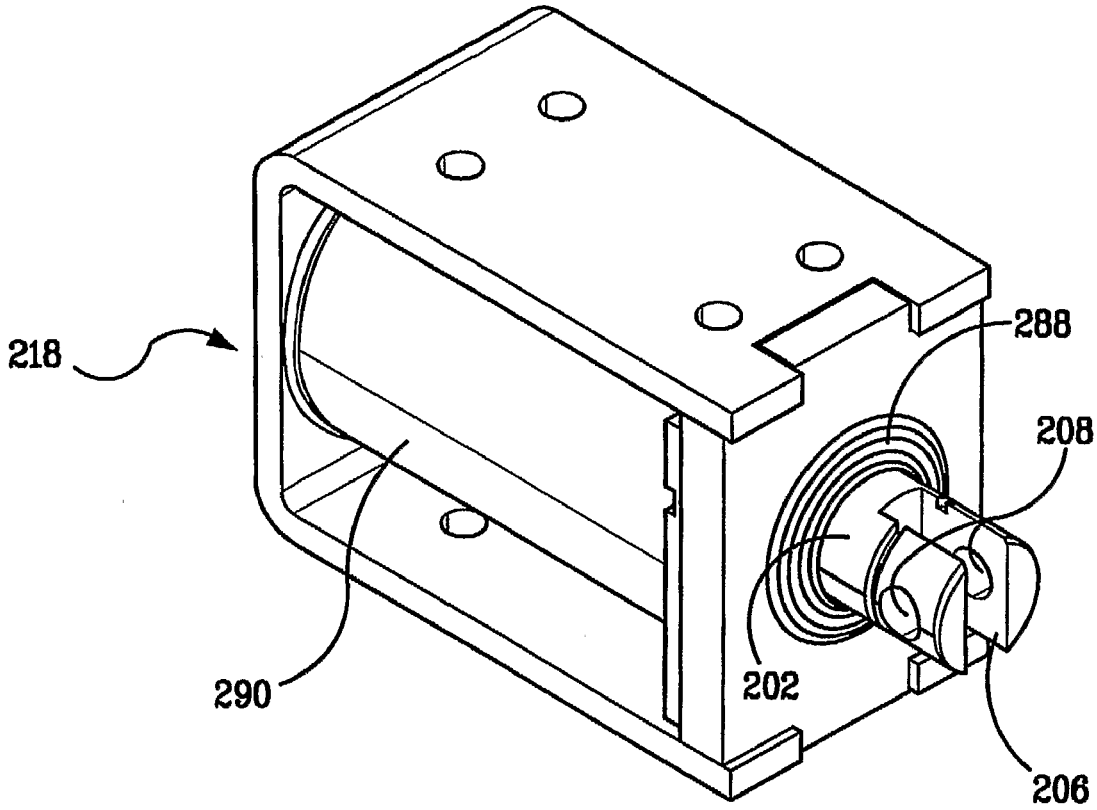
FIG. 31 is an isometric view of a solenoid that can be used as part of the actuating mechanism of the latch assembly in accordance with the first embodiment of the present invention.
Figure 32:
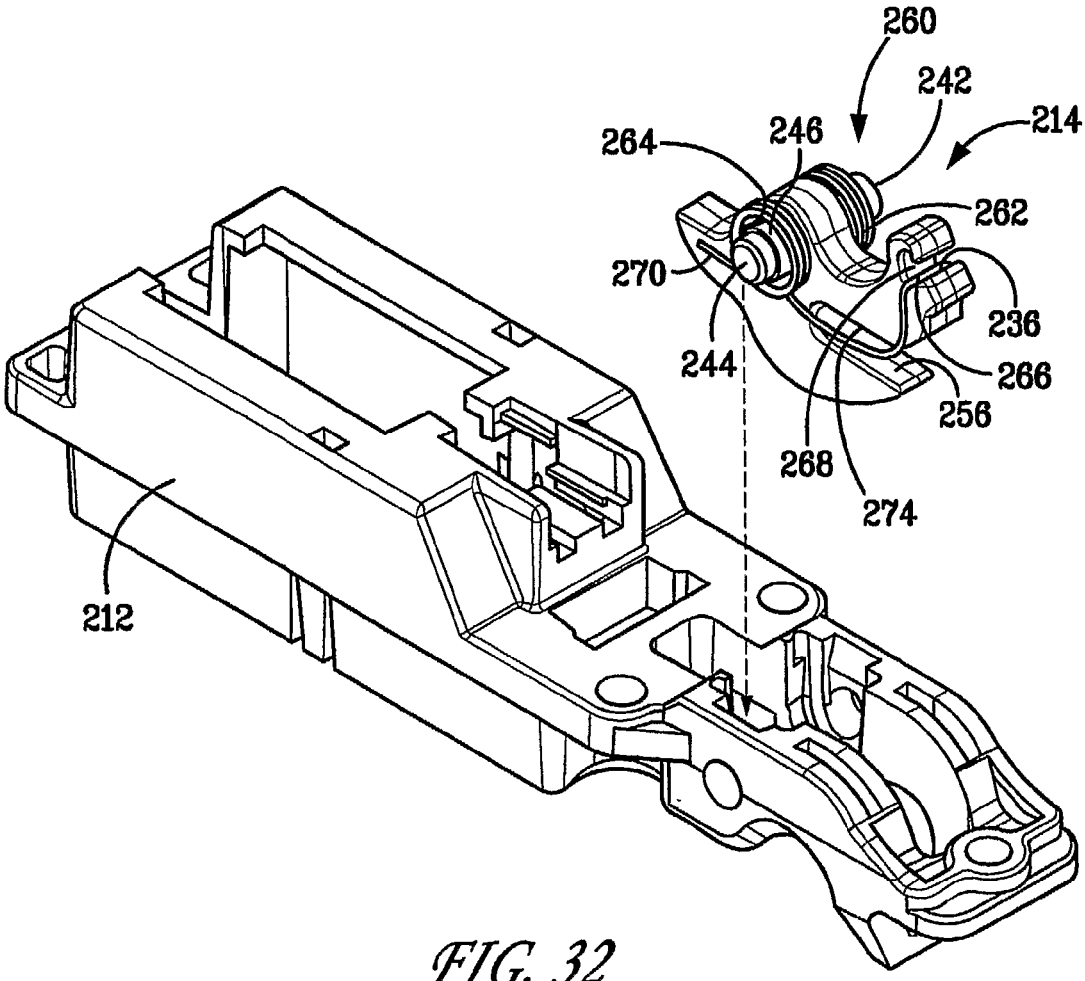
FIGS. 32-37 are views showing the assembly sequence of a latch assembly in accordance with the first embodiment of the present invention.
Figure 33:
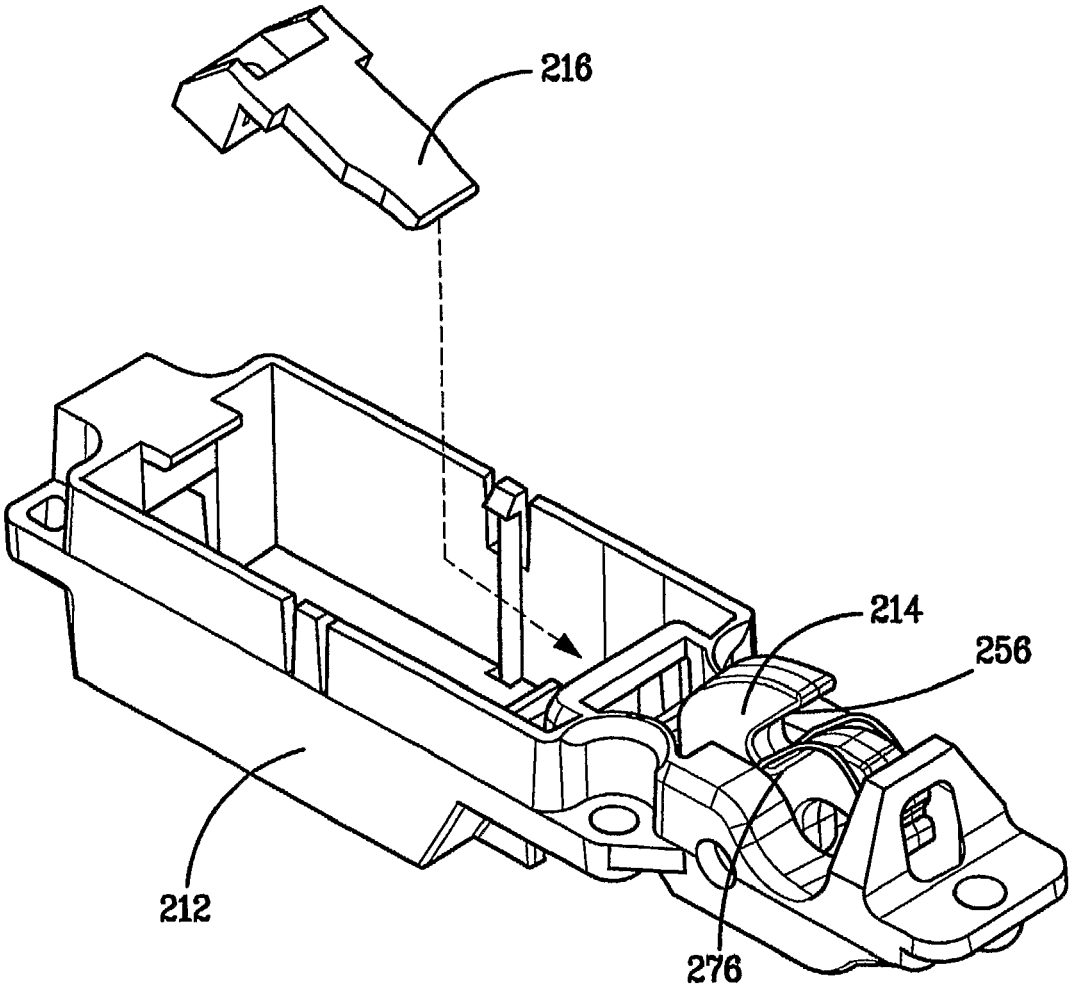
Figure 34:
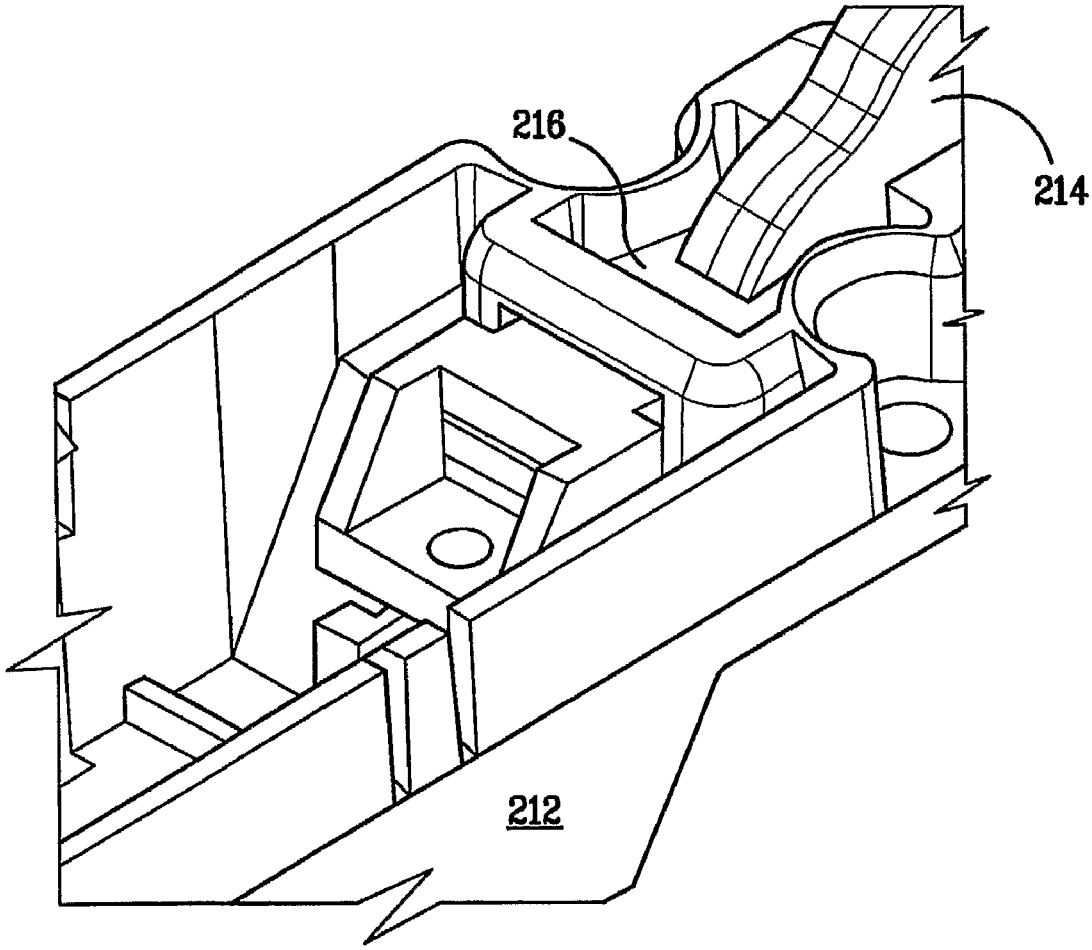
Figure 35:
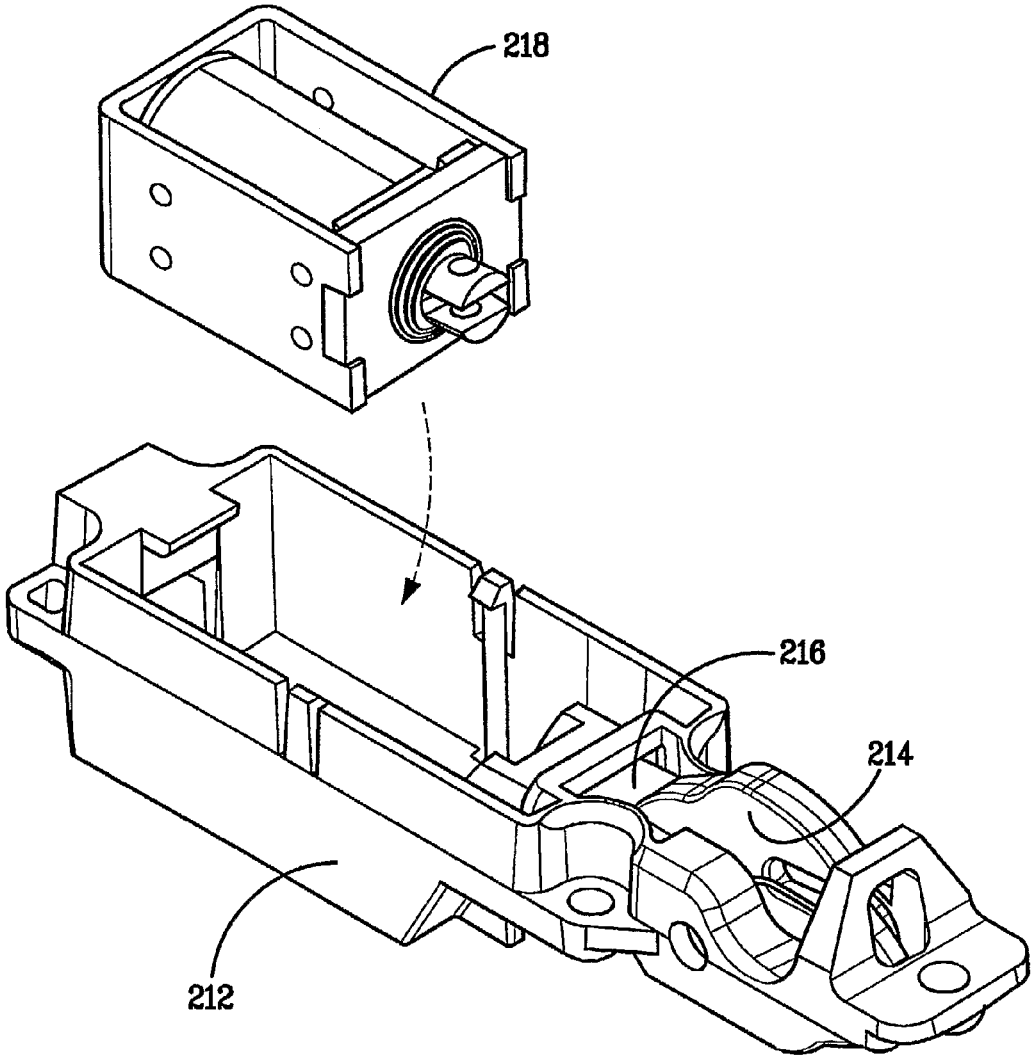
Figure 36:
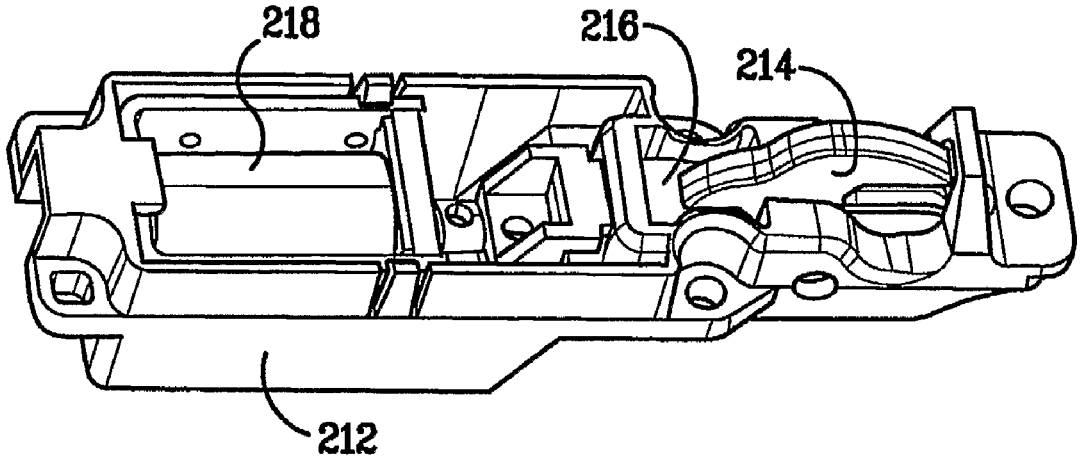
Figure 37:
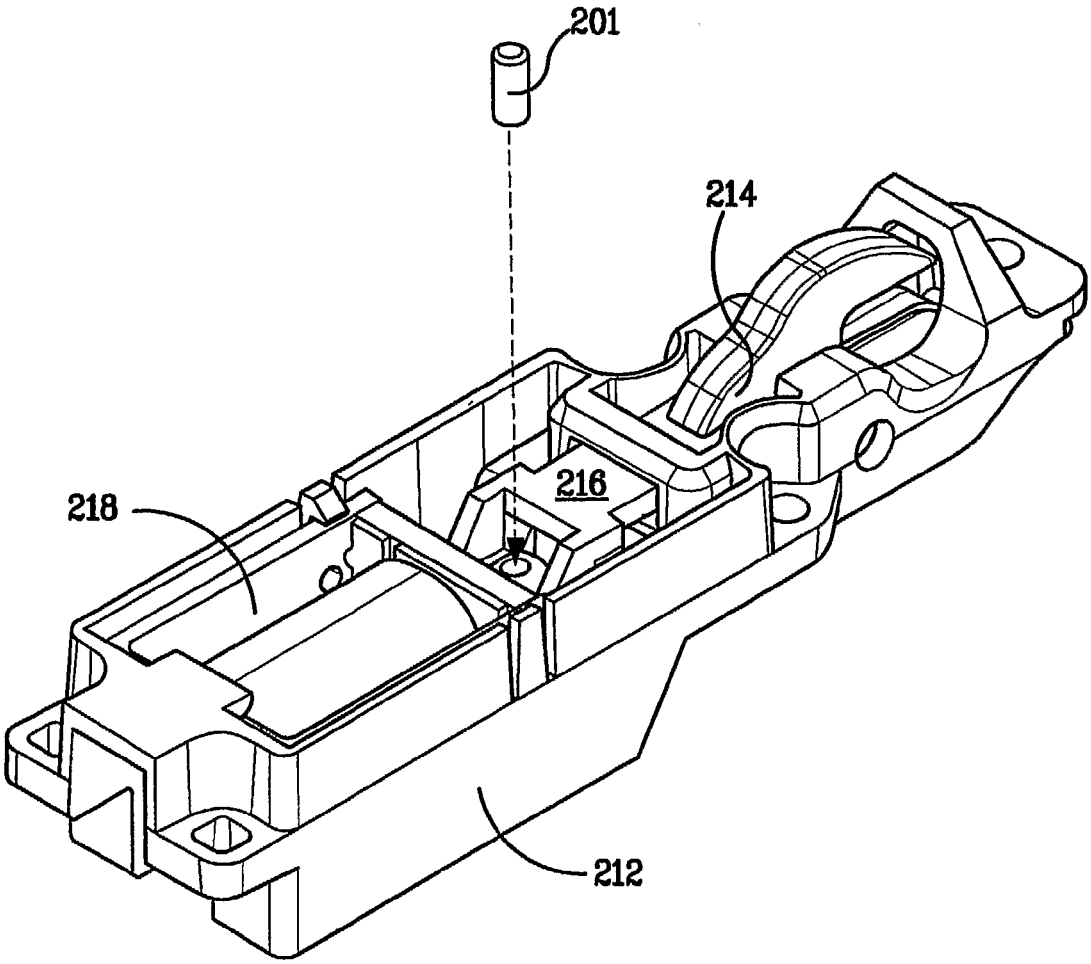
Figure 39:
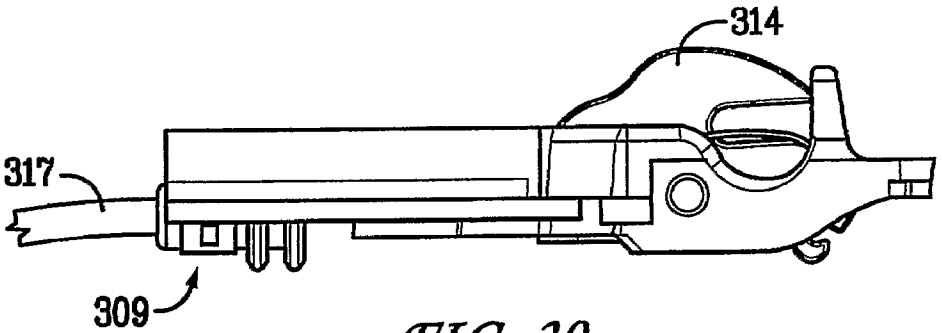
FIGS. 38-45 are views of a latch subassembly of a latch assembly in accordance with the second embodiment of the present invention.
Figure 40:
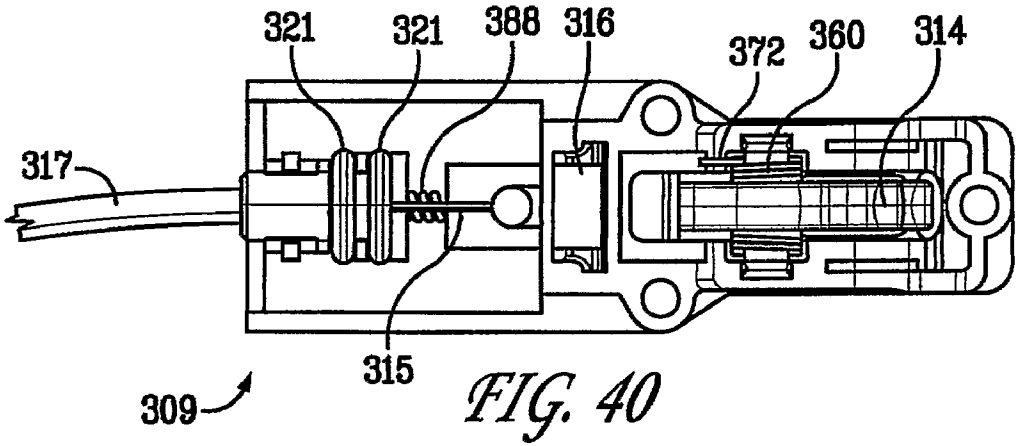
Figure 38:
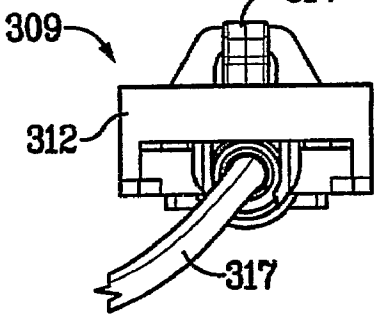
Figure 42:
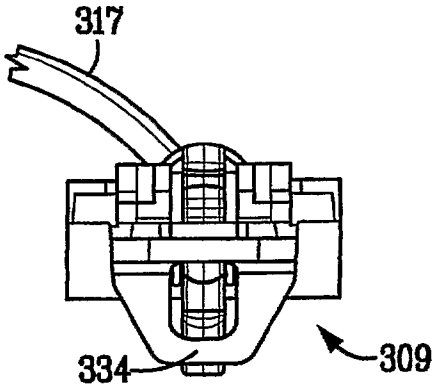
Figure 41:
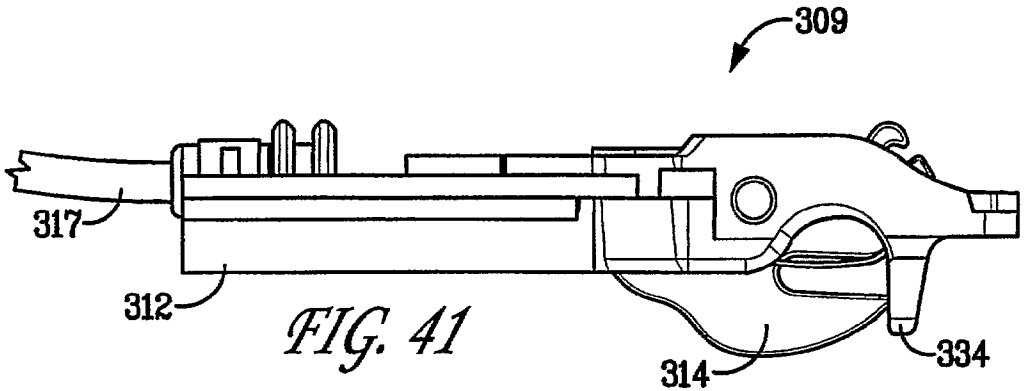
Figure 43:
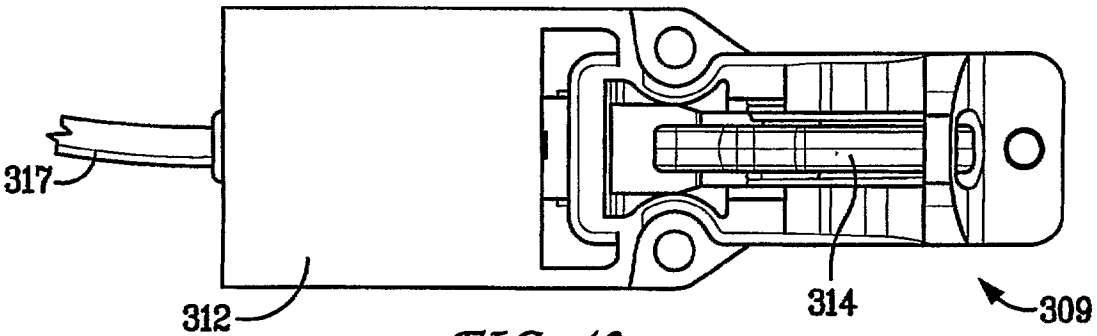
Figure 44:
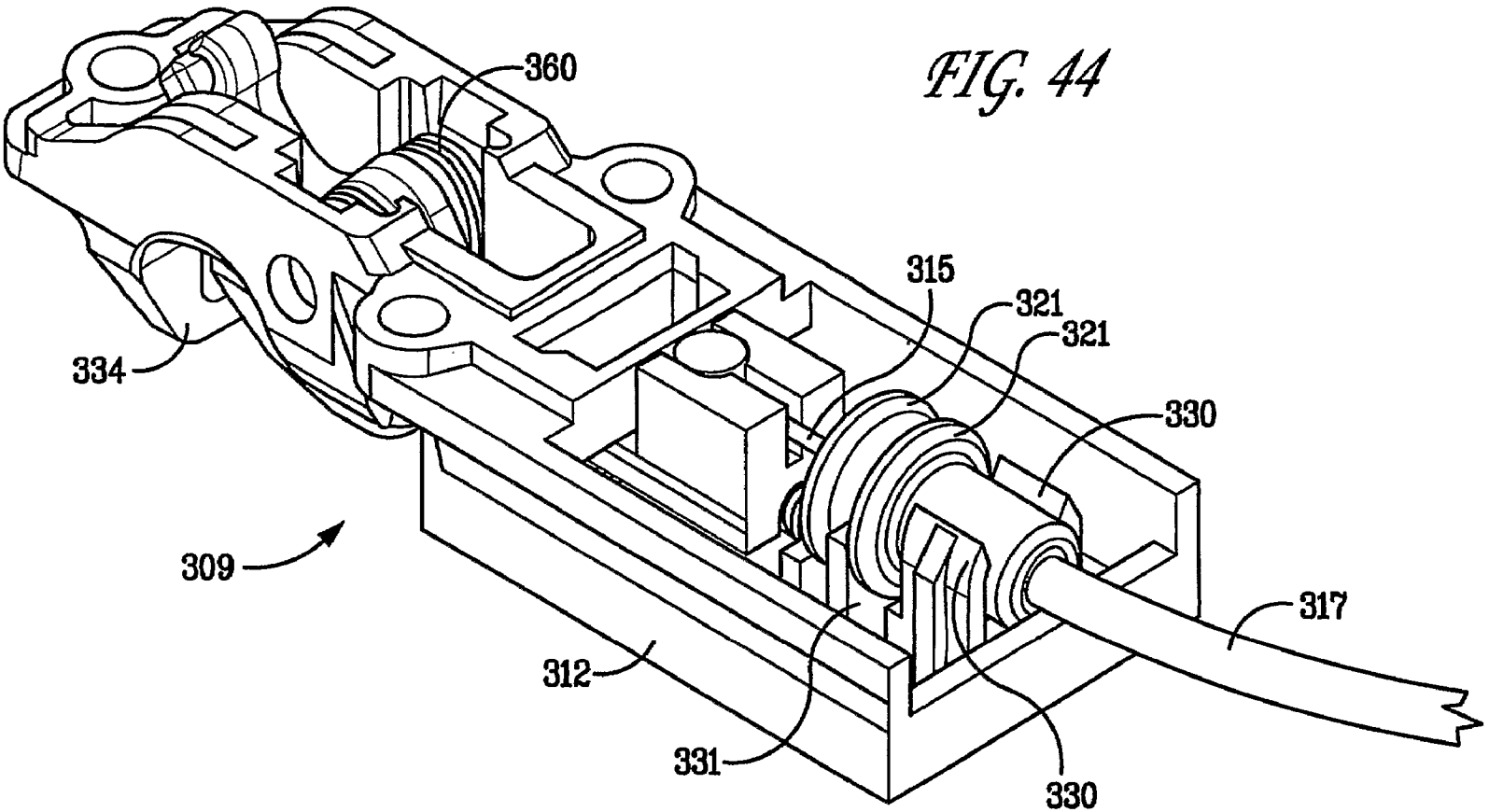
Figure 45:
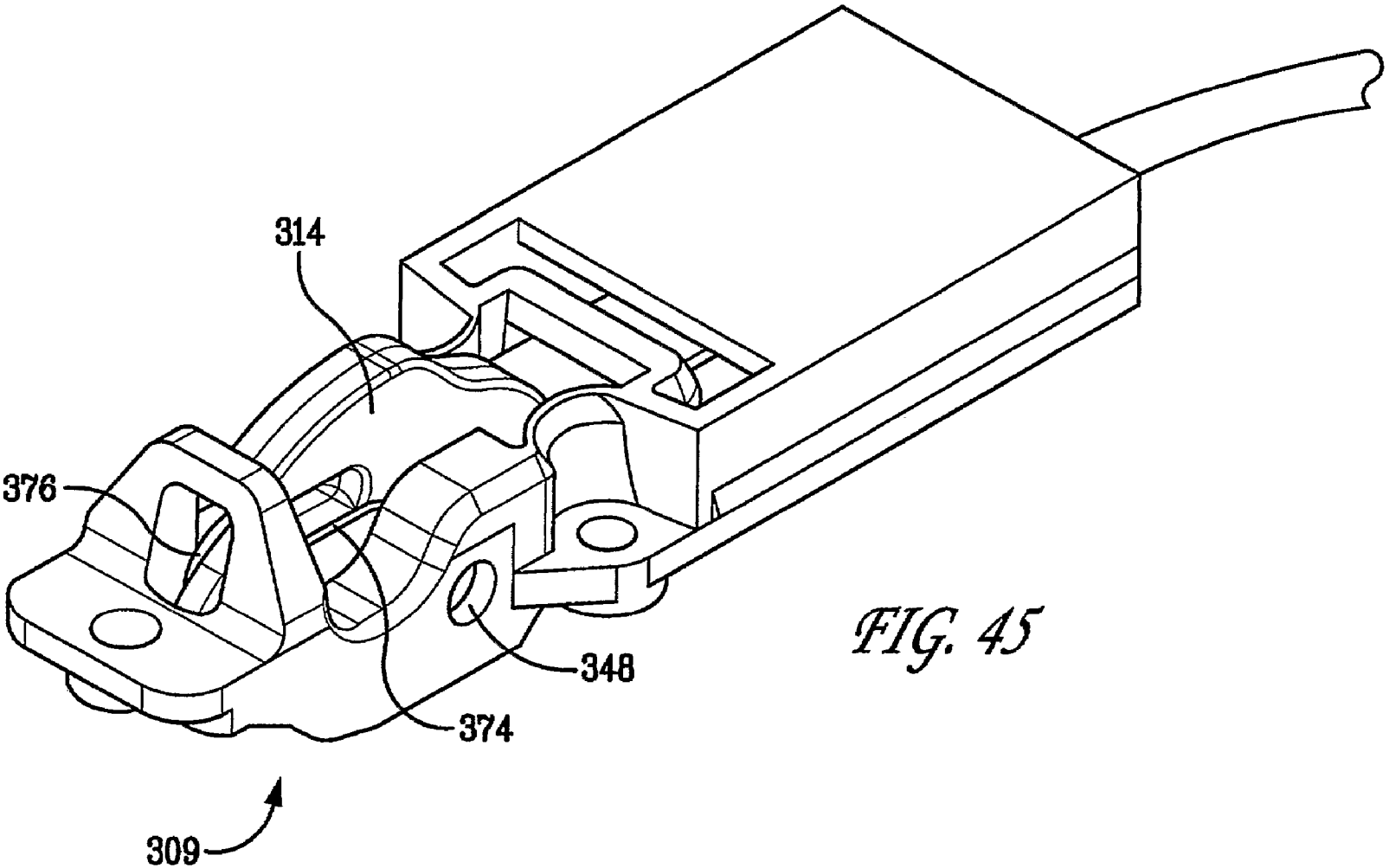
Figure 46:
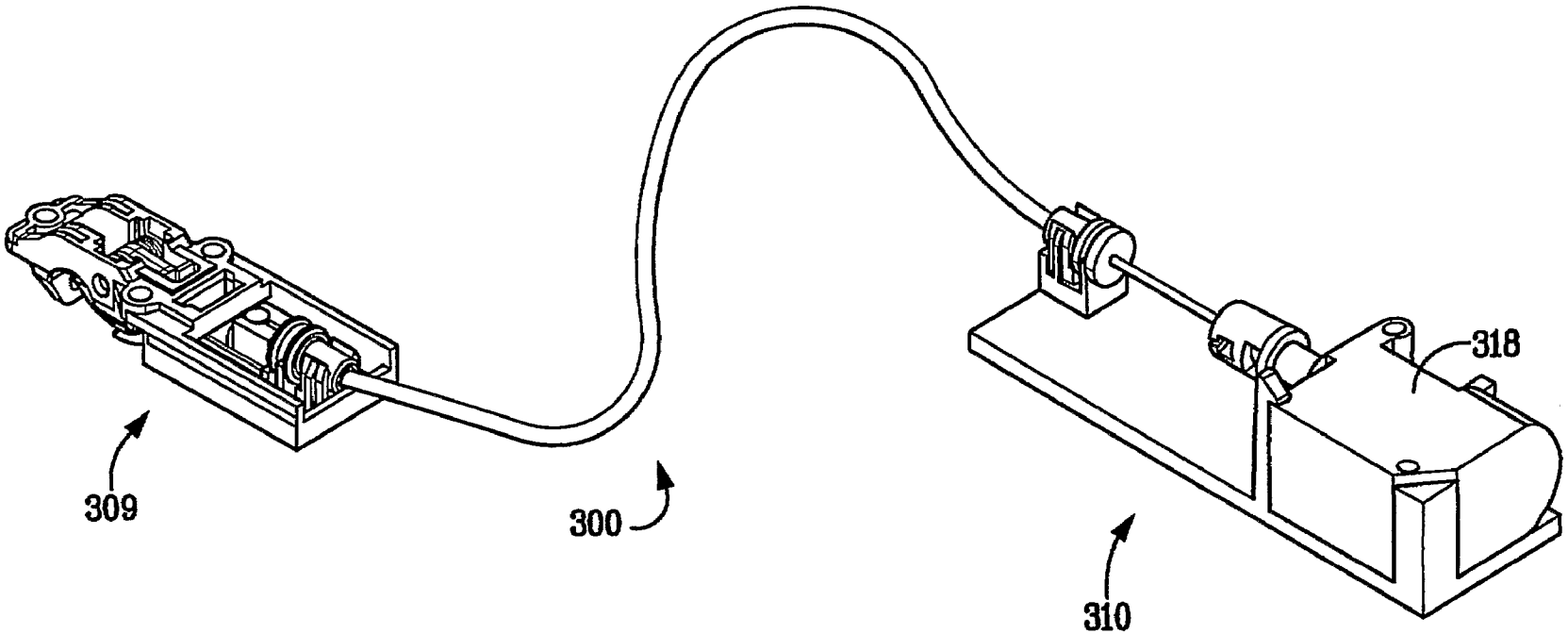
FIG. 46 is an isometric view of a latch assembly in accordance with the second embodiment of the present invention showing both the latch subassembly and the actuating mechanism.
Figure 47:
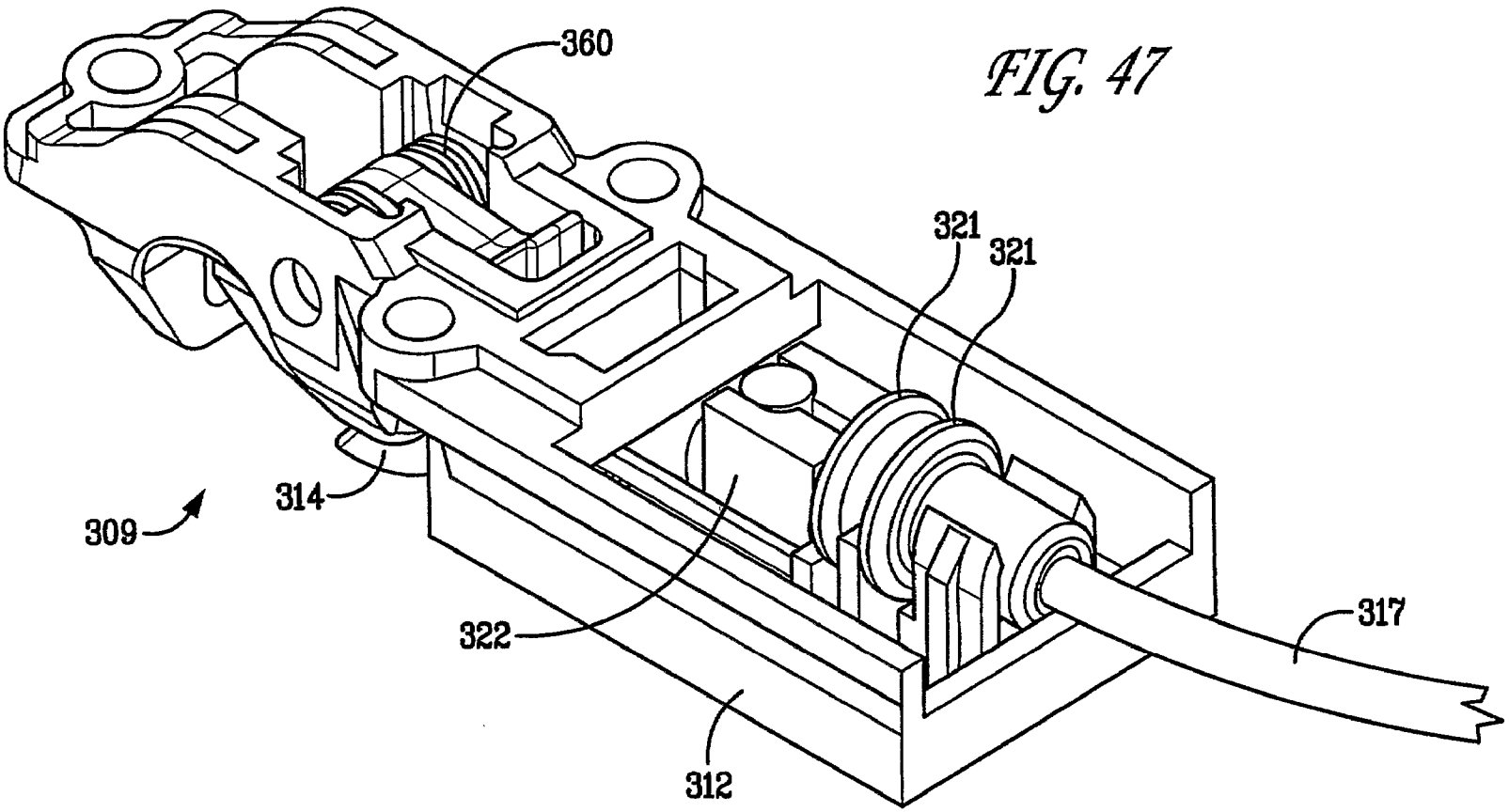
FIG. 47 is an isometric view showing the latch subassembly of the latch assembly in accordance with the second embodiment of the present invention in the open position.
Figure 48:
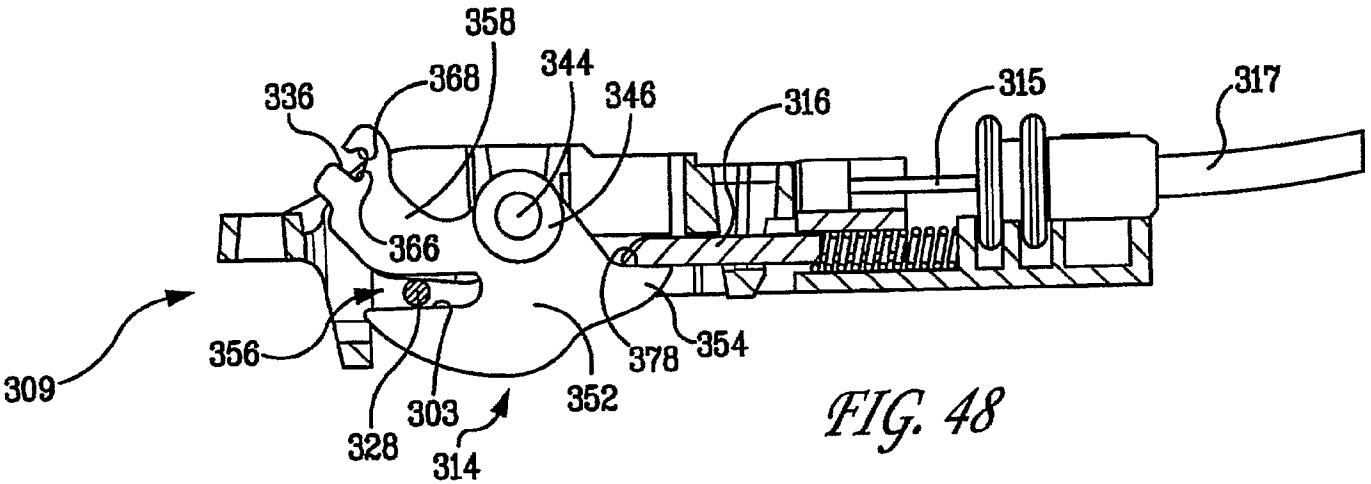
FIG. 48 is a cross sectional view showing the latch subassembly of the latch assembly in accordance with the second embodiment of the present invention in the closed position.
Figure 49:
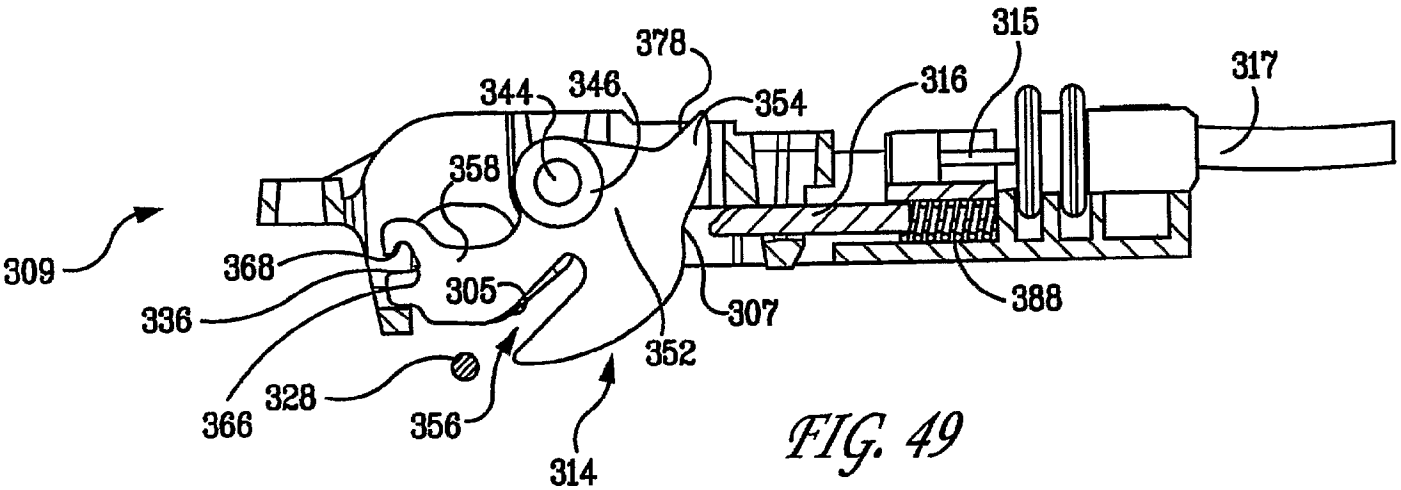
FIG. 49 is a cross sectional view showing the latch subassembly of the latch assembly in accordance with the second embodiment of the present invention in the open position.
Figure 50:
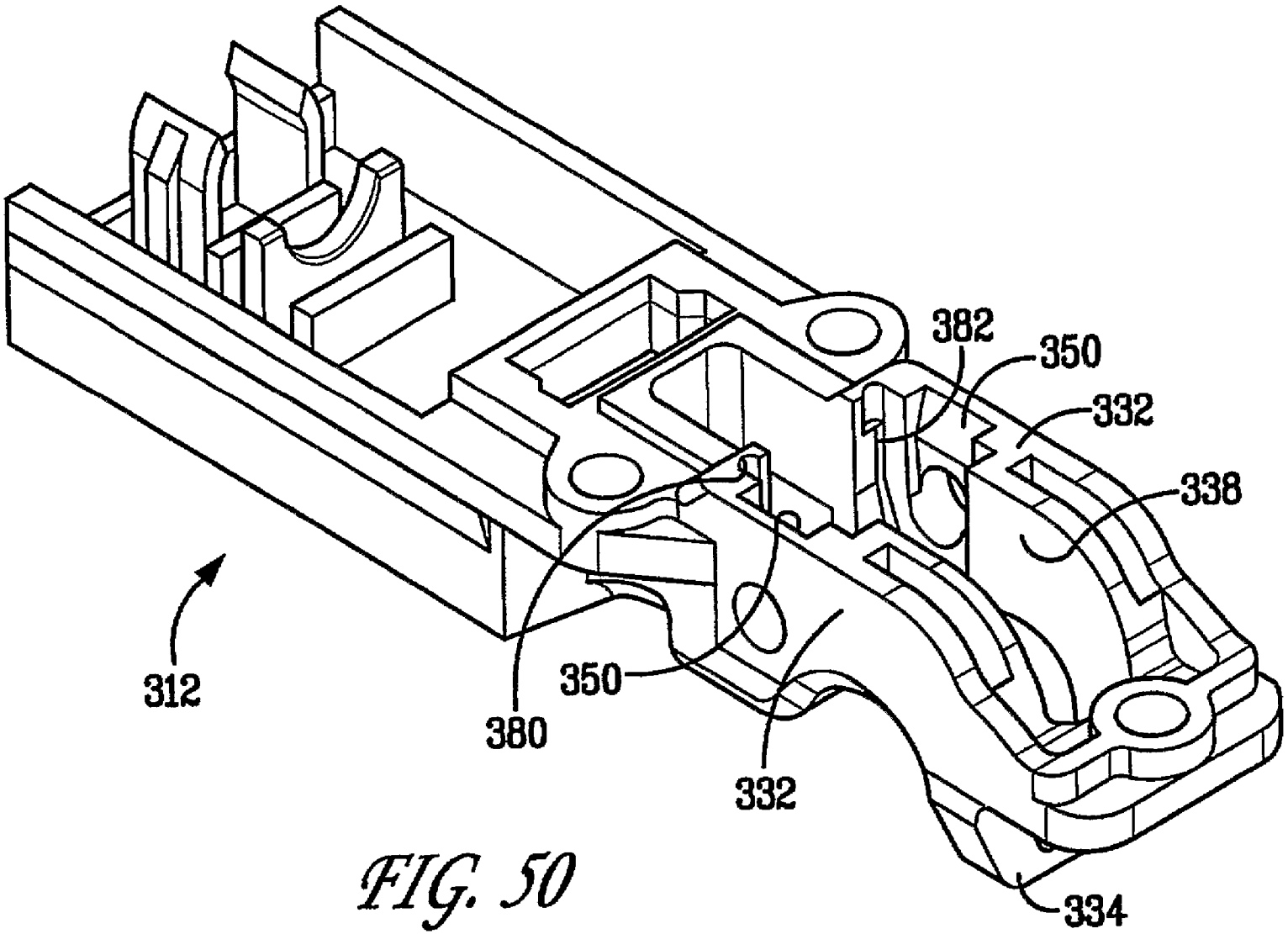
FIGS. 50-56 are views of the housing of the latch subassembly of the latch assembly in accordance with the second embodiment of the present invention.
Figure 53:
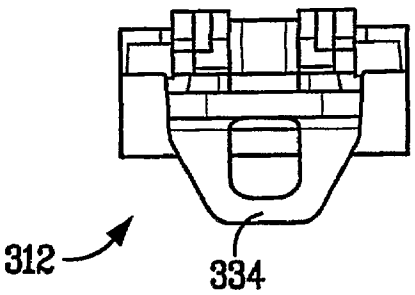
Figure 51:
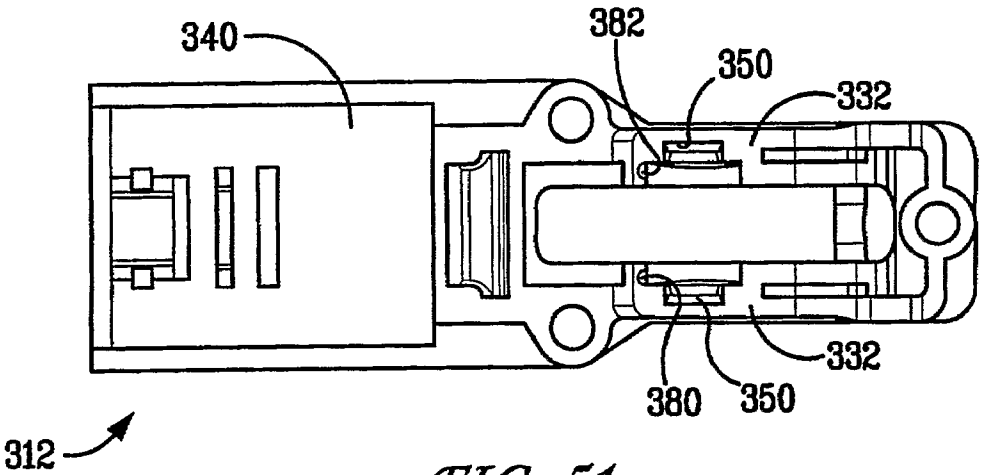
Figure 52:
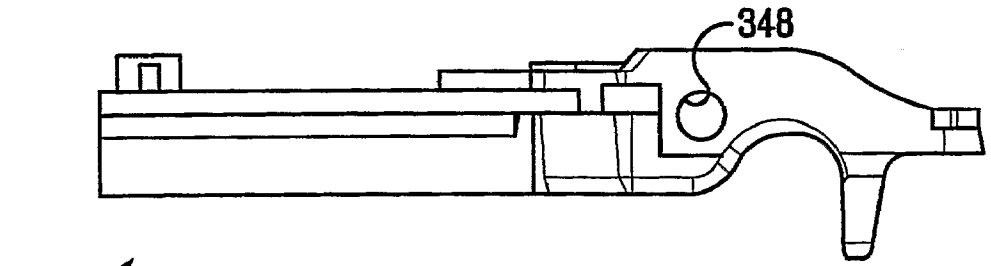
Figure 55:
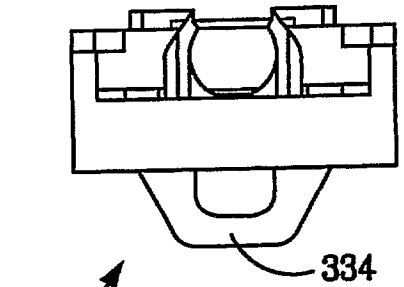
Figure 54:
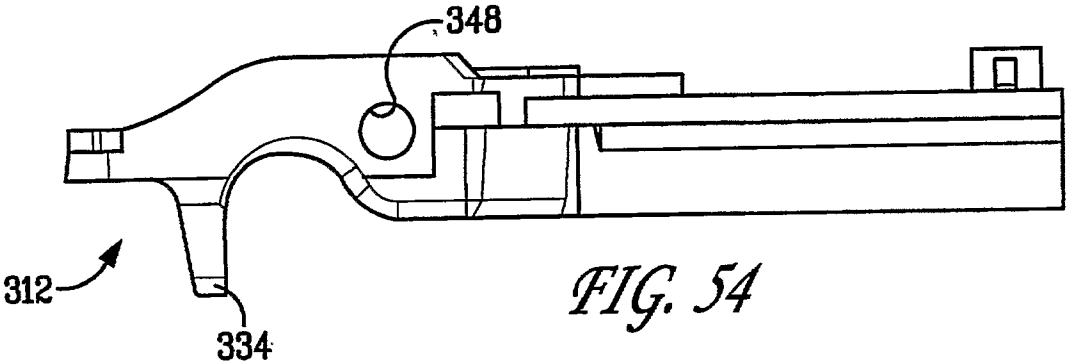
Figure 56:
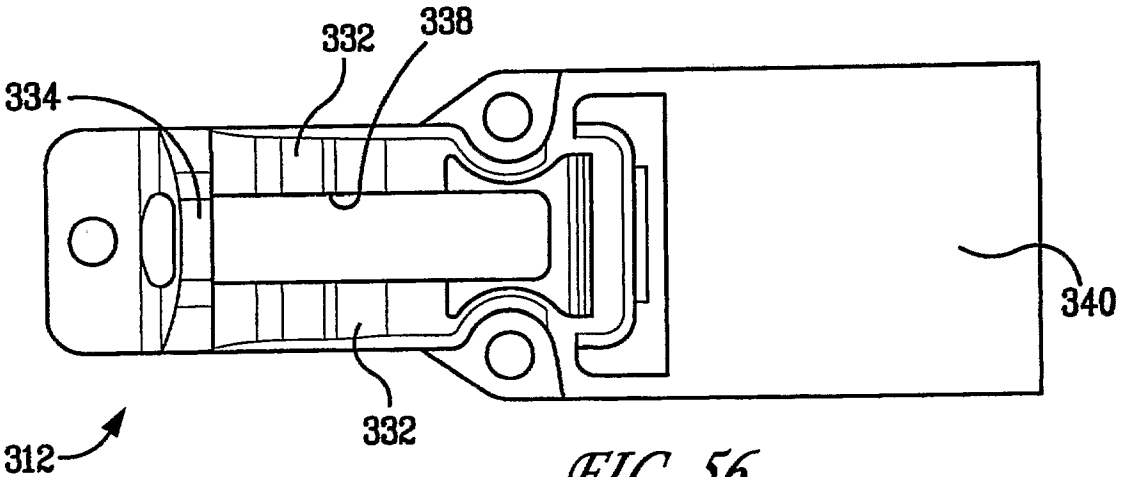
Figure 58:
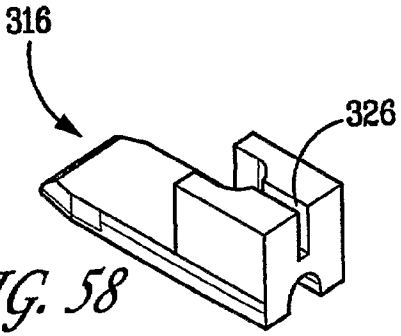
FIGS. 57-63 are views of the locking member of the latch assembly in accordance with the second embodiment of the present invention.
Figure 61:
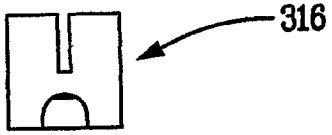
Figure 63:
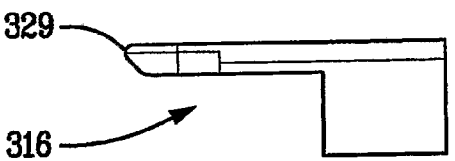
Figure 60:
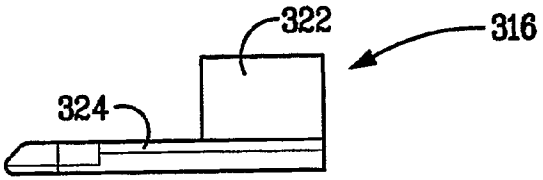
Figure 57:
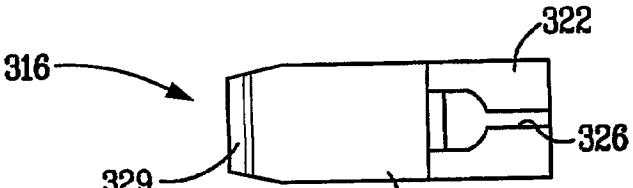
Figure 59:
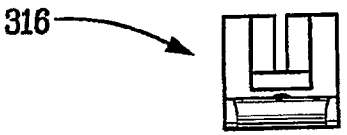
Figure 62:
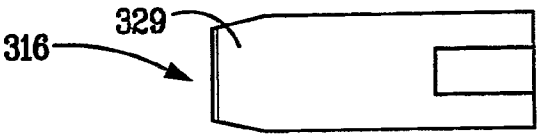
Figure 65:
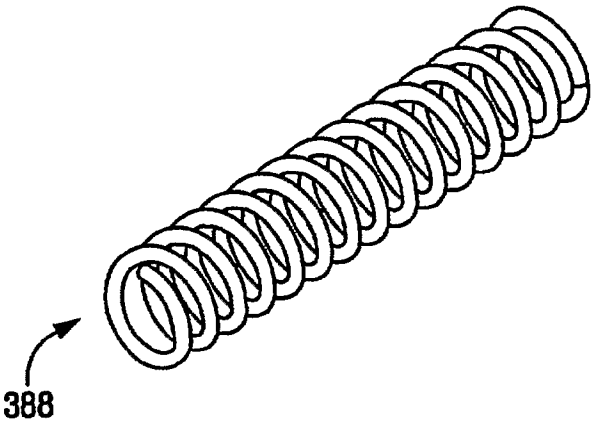
FIGS. 64-67 are views of the spring for biasing the locking member of the latch assembly in accordance with the second embodiment of the present invention.
Figure 67:
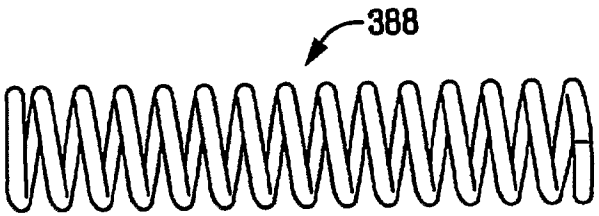
Figure 64:
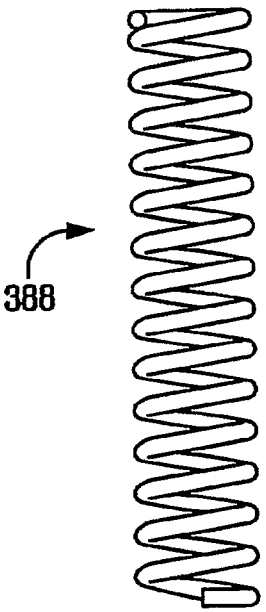
Figure 66:
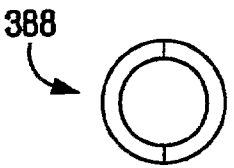
Figure 68:
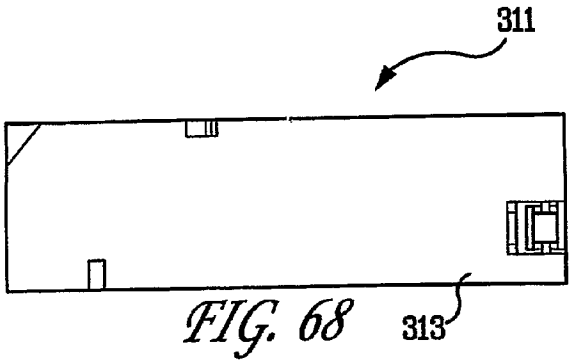
FIGS. 68-72 are views of the housing of the actuating mechanism of the latch assembly in accordance with the second embodiment of the present invention.
Figure 70:
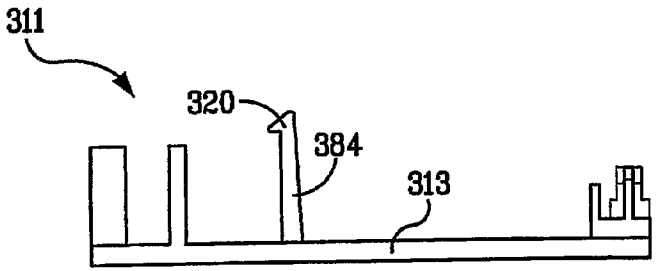
Figure 71:
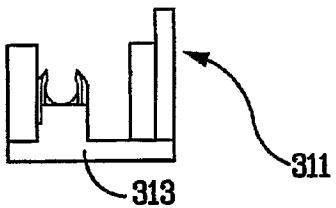
Figure 69:
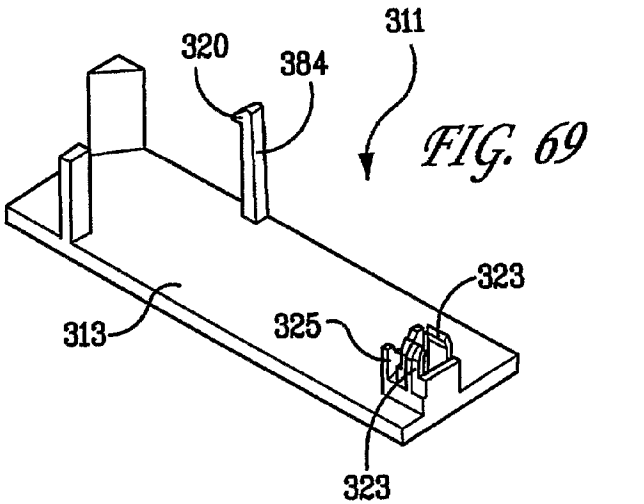
Figure 72:
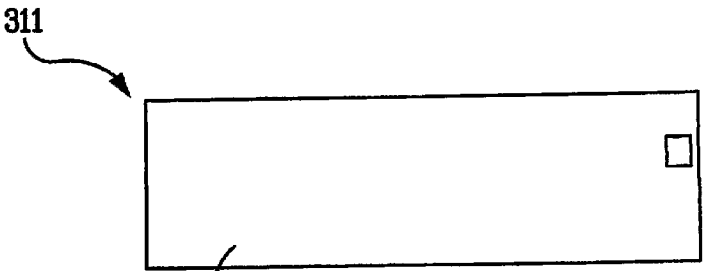
Figure 73:
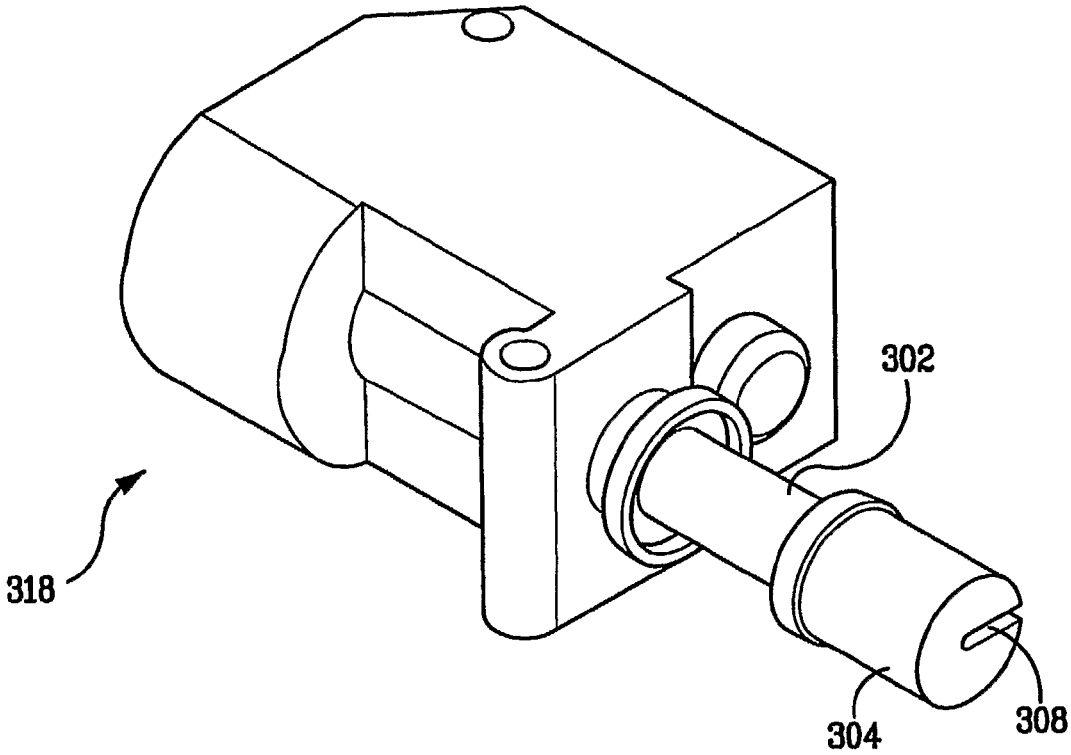
FIG. 73 is an isometric view of a linear actuator that can be used as part of the actuating mechanism of the latch assembly in accordance with the second embodiment of the present invention.
Figure 74:
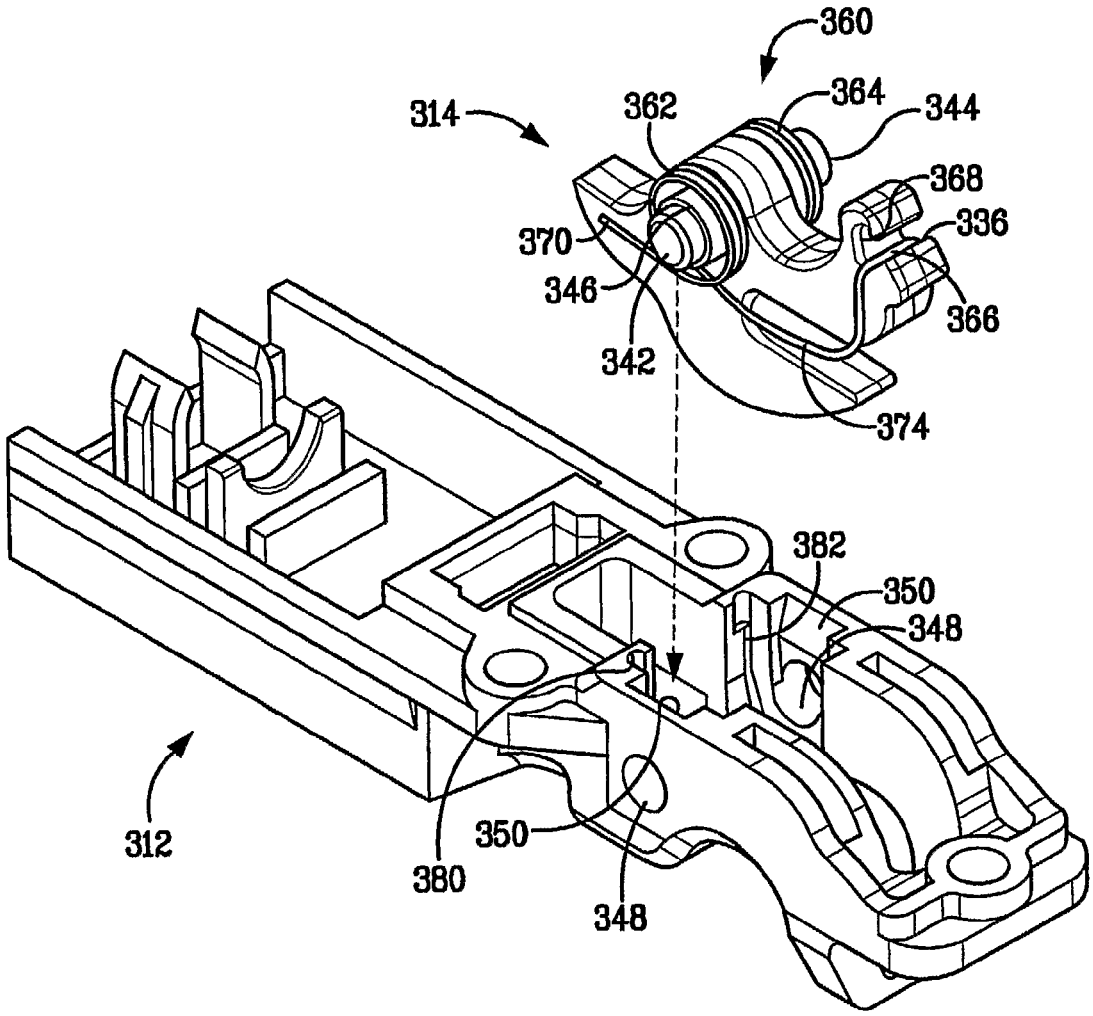
FIGS. 74-80 are views showing the assembly sequence of a latch assembly in accordance with the second embodiment of the present invention.
Figure 75:
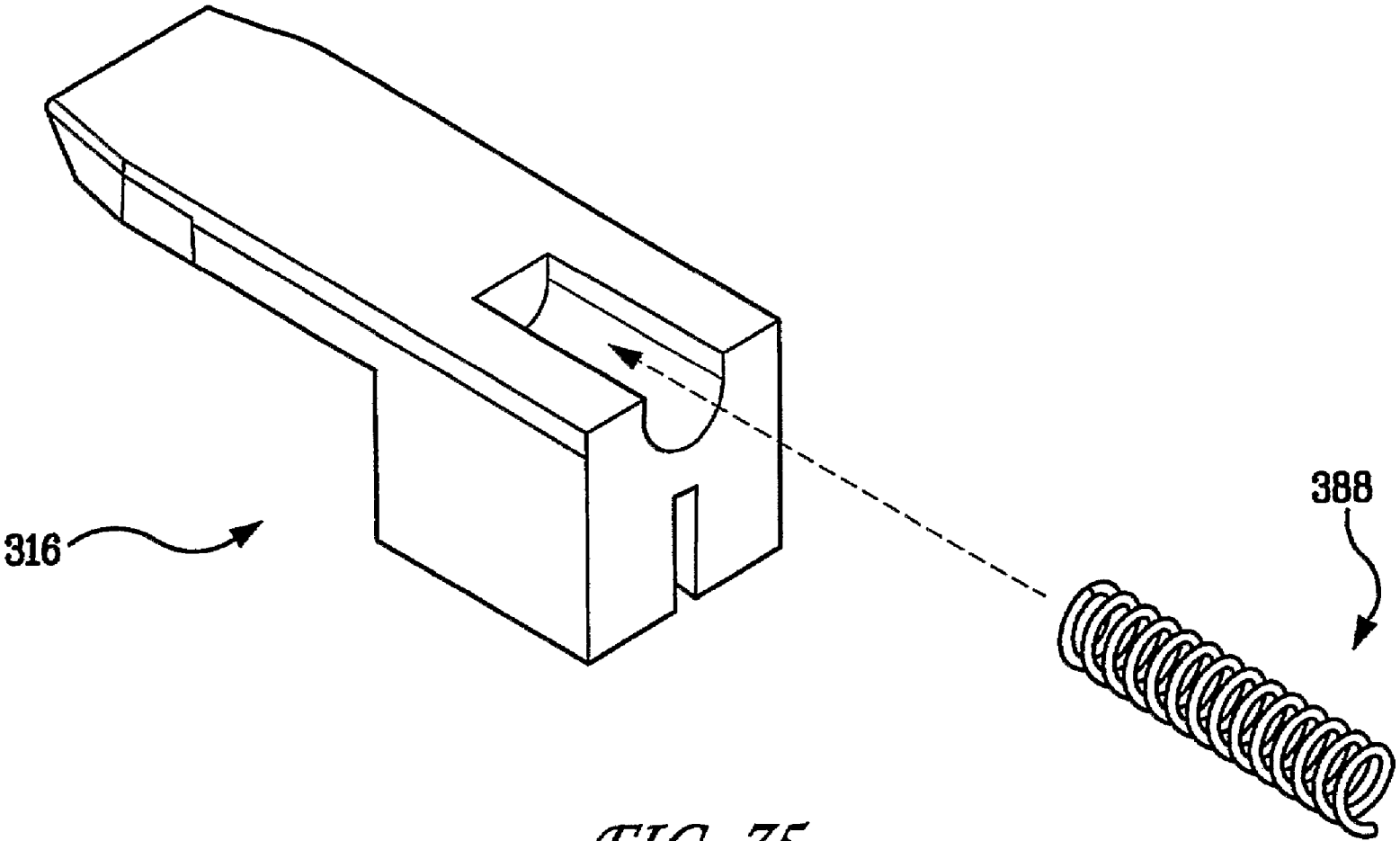
Figure 76:
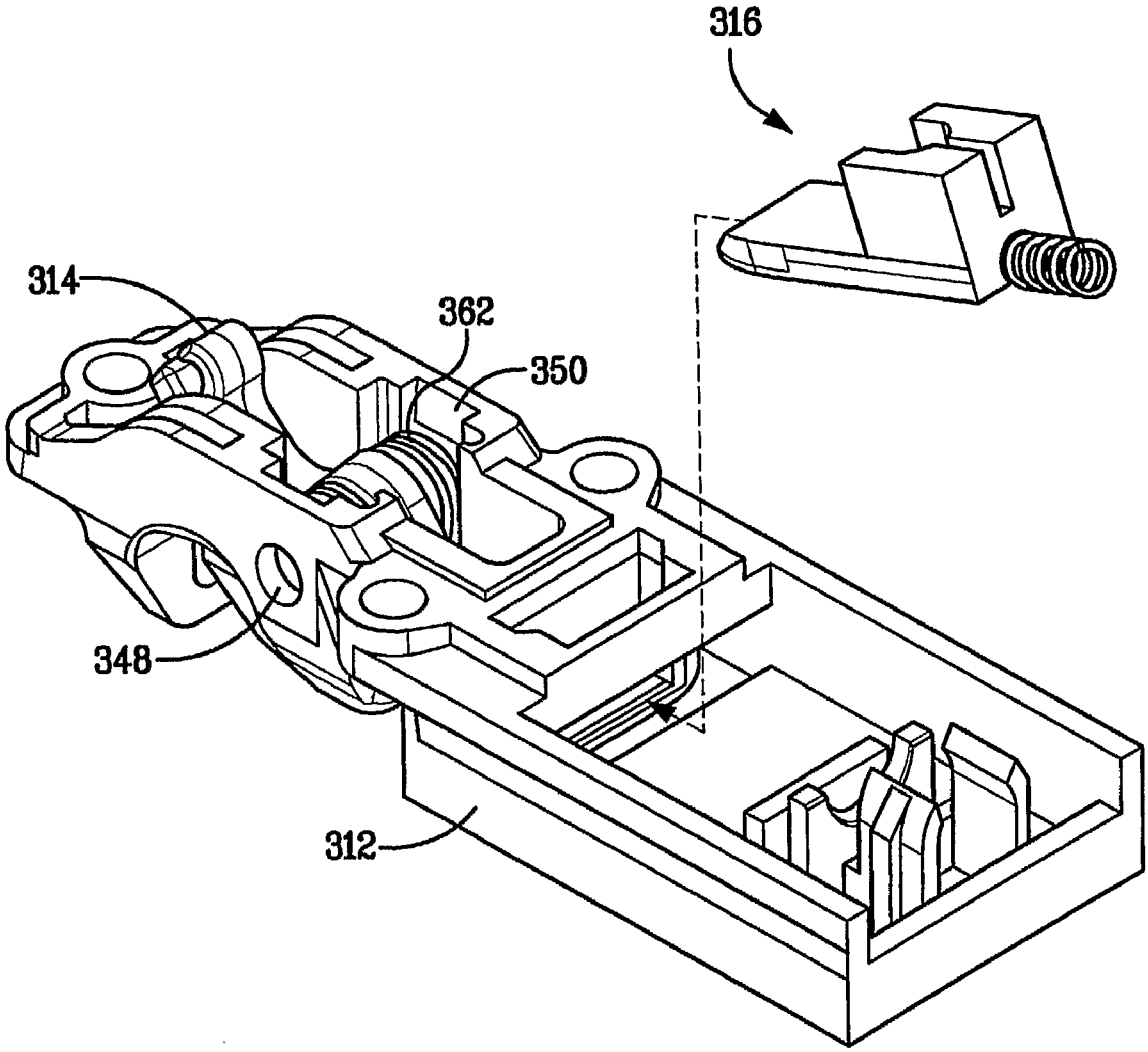
Figure 77:
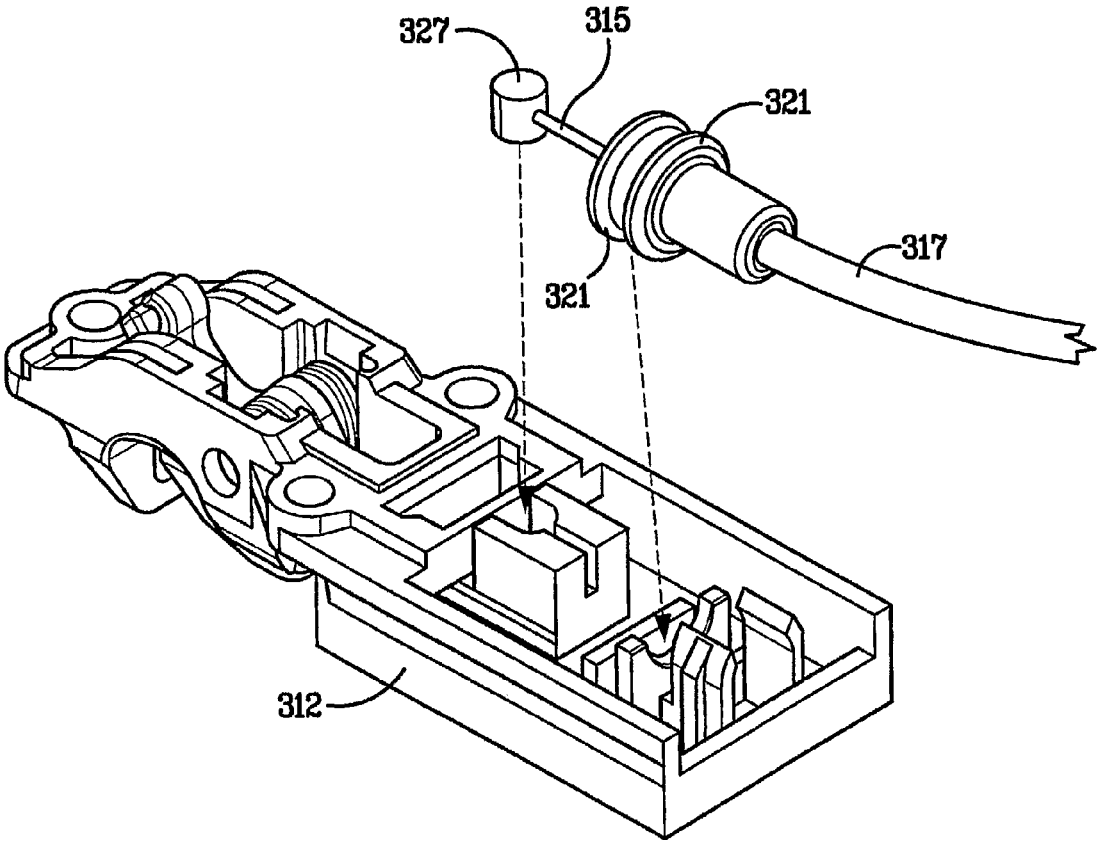
Figure 78:
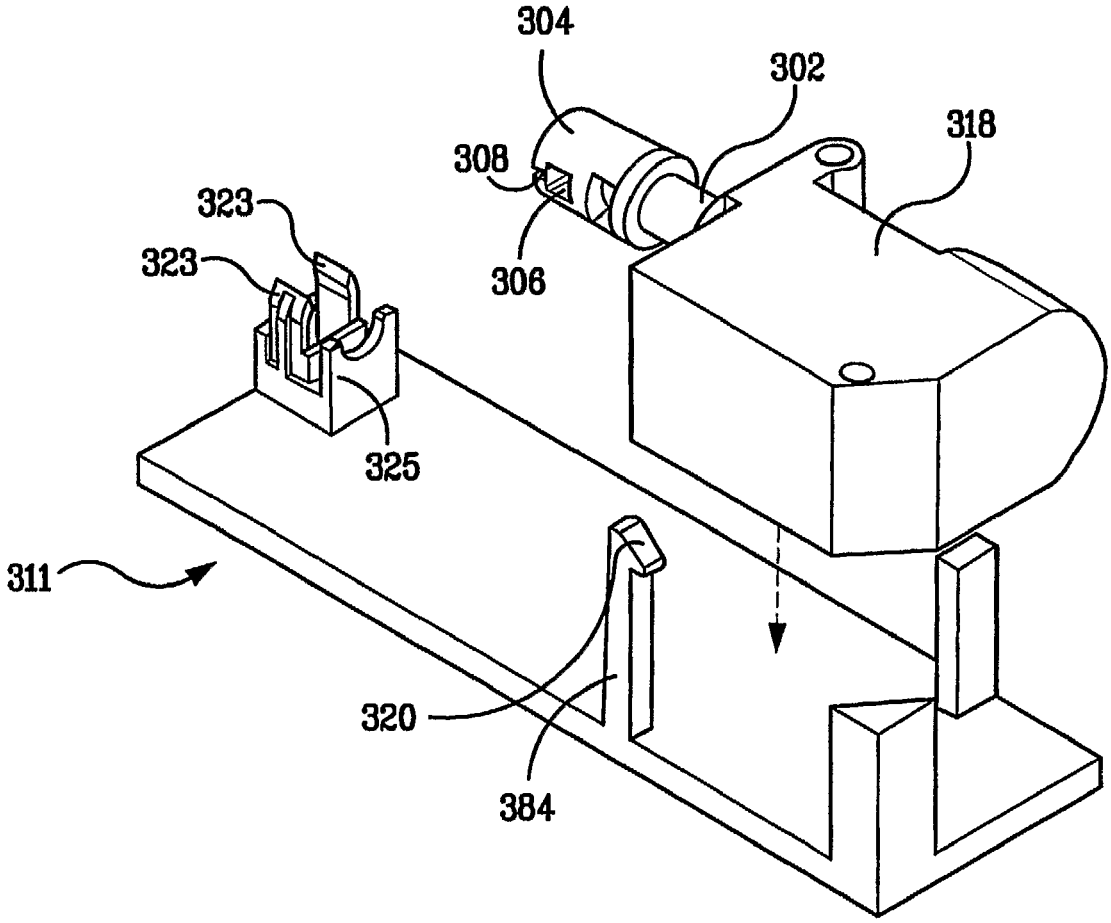
Figure 79:
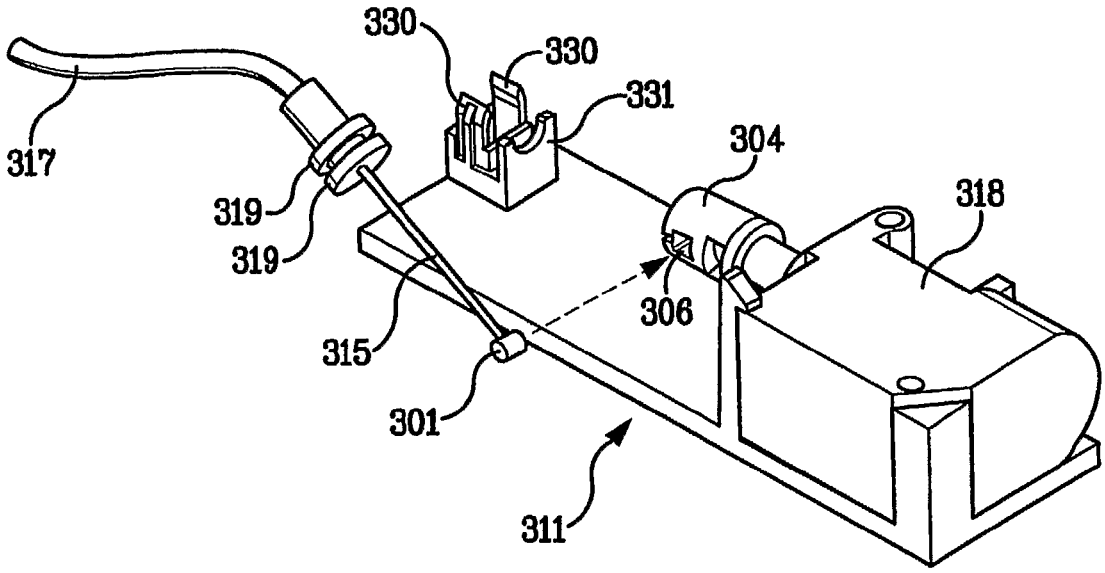
Figure 80:
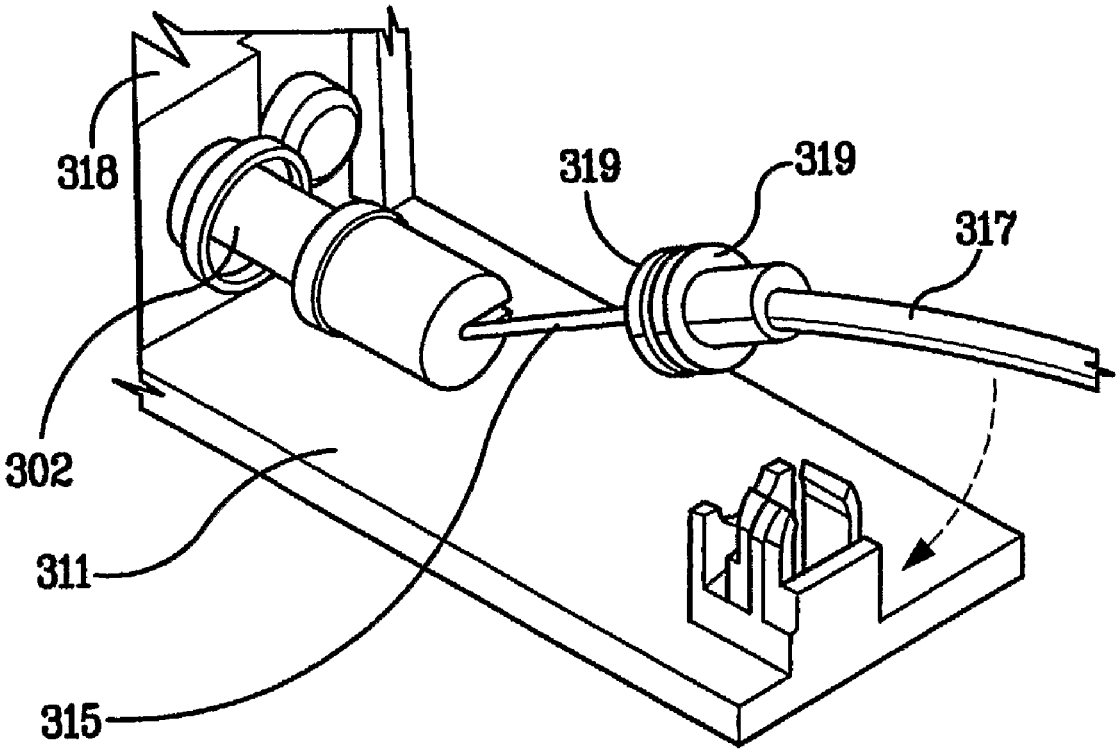
Figure 83:
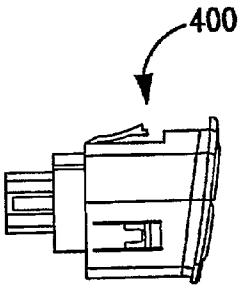
FIGS. 81-87 are views of a rocker switch assembly in accordance with the present invention.
Figure 87:
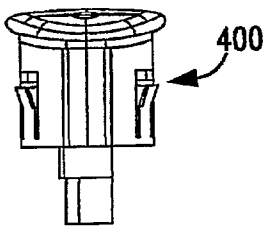
Figure 85:
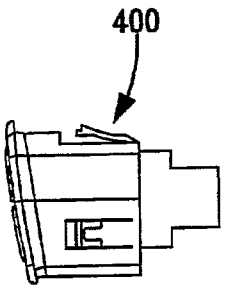
Figure 82:
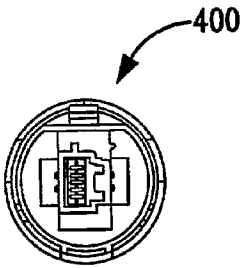
Figure 86:
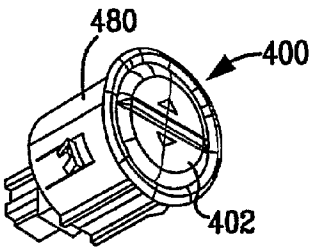
Figure 84:
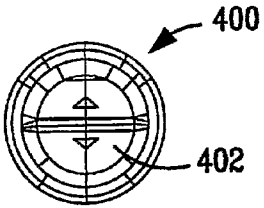

The reference numerals indicate the corresponding features consistently throughout the attached drawings.

DETAILED DESCRIPTION OF THE INVENTION

Referring to FIGS. 1-37, the latch assembly 200 that is illustrative of the first embodiment of the present invention can be seen. The latch assembly 200 includes a latch housing 212, a pawl 214, a locking member 216, and an actuating mechanism 210. The actuating mechanism 210 provides means for selectively moving the locking member 216 out of engagement with the pawl 214. In the illustrated embodiment, a solenoid 218 serves as part of the actuating mechanism 210, which in the illustrated example is electrically powered.

The latch assembly 200 may, for example, be used for securing the door or lid of an automotive glove box (not shown) in the closed position. However, the latch assembly 200 has numerous other applications. The latch assembly 200 can be mounted to either the door or the doorframe depending upon the particular application. In addition, the latch assembly 200 may be mounted in any orientation depending upon the particular application. Some examples of the environments in which the latch assemblies of the present invention may be used can be seen in U.S. Pat. No. 5,927,772, issued on Jul. 27, 1999 and U.S. Patent Application Publication Number US 2003/0025339 A1, published on Feb. 6, 2003, both of which are incorporated herein by reference in their entirety.

The latch assembly 200 includes a pawl 214 shown pivotally connected to the latch housing 212 with suitable attachment means such as the pawl pivot members or spindles 242, 244 which are provided extending outwardly from the pawl 214 at opposite sides thereof. The pivot members 242, 244 can also be provided as a single pivot member extending through the pawl 214. A pair of larger diameter base portions 246 are provided at the base of the pawl pivot members 242, 244. Portions 232 of the housing 212 extend on either side of the pawl 214 such that they define a slot 238. At least a portion of the pawl 214 is received or positioned within the slot 238. The base portions 246 prevent excessive lateral play of the pawl 214 once the pawl is installed to the housing 212 while maintaining sufficient clearance between the sides of the pawl 214 and the portions 232 of the housing 212 to accommodate the coiled portions of the pawl torsion spring 260.

The portions 232 of the housing 212 continue extending on either side of the pawl 214 away from the axis of rotation of the pawl 214 until they meet an overhanging portion 234. The overhanging portion 234 juts outward from the portions 232 and overhangs at least a portion of the pawl 214. The portions 232 are at least in part set back relative to the pawl slot 256 when the pawl 214 is in the latched position, such that the portions 232 do not overlap the portion of the pawl slot where the keeper member 228 is located. Thus, the portions 232 will not interfere with the movement of the keeper member 228 relative to the pawl 214 to the closed or latched position. The housing 212 also has a base plate 240 for supporting the solenoid 218.

The pawl 214 is installed onto the housing 212 by snap-fit placement of the pawl pivot members 242, 244 into the pawl pivot recesses 248 disposed in the respective housing portions 232 on opposite sides of the slot 238. A pair of guide slots 250 are provided in the respective housing portions 232 on either side of the slot 238 which lead to the recesses 248. The pair of guide slots 250 form ramped surfaces which spread farther apart from one another with increasing distance from the recesses 248. The guide slots 250 guide the pawl pivot members 242, 244 in the direction of the pawl pivot recesses 248 during the snap-fitting process.

As shown in FIGS. 11, 12, and 32-37, the pawl 214 has a body portion 252. The pair of pawl pivot members 242, 244 project from either side of the pawl body portion 252. The pawl 214 has a lug or projection 254 and is provided with a pawl slot 256 to retain the keeper member 228 when the pawl 214 is in the latched position. The keeper member 228 is, for example, attached to the lid of a glove box at a position such that when the swinging lid or door of the glove box is closed, the keeper member 228 will be positioned and captured in the pawl slot 256 with the pawl 214 in the latched position illustrated in FIGS. 1-9 and 11. The pawl 214 is also provided with an arm portion 258 extending from the pawl body 252.

The pawl torsion spring 260 is installed on the pawl 214 with the coiled portions 262 and 264 surrounding the base portions 246 of the pawl pivot members 242 and 244, respectively. The cross bar 266 of the torsion spring 260 engages a surface 236 that is a radial distance away from the axis of rotation of the pawl 214 such that the pawl torsion spring 260 imparts a torque to the pawl 214 that biases the pawl 214 toward the unlatched position. In the illustrated example, the surface 236 is provided in the notch 268 near the tip of the arm portion 258. The torsion spring 260 also has tail portions 270, 272 and arms 274, 276. The vertical spring arms 274, 276 extend from the respective coil portions 262 and 264 of the torsion spring 260 and connect to cross bar 266. The pawl arm 258 is positioned intermediate the spring arms 274 and 276. The pawl 214 is installed in the housing 212 from the side of the housing portions 232 opposite the side from which the overhanging portion 234 projects. The projection or lug 254 has a flat surface 278 that extends roughly in a radial direction relative to the axis rotation of the pawl 214.

The tails 270, 272 of the torsion spring 260 fit into and lie along the grooves 280, 282, respectively, when the pawl 214 is snap-fitted to the housing 212. With the tails 270, 272 of the torsion spring 260 so positioned, the cross bar 266 of the torsion spring 260 exerts a force on the arm portion 258 of the pawl 214 that biases the pawl 214 toward the open or unlatched configuration.

The solenoid 218 is supported on the base plate 240 and is held in position by resilient arms 284 that have catch teeth or barbs 220 at their tips. The catch teeth or barbs 220 have a saw tooth profile. The locking member 216 is in the form of an elongated flat plate 224 that has a shorter parallel plate 222 provided to one side thereof. The shorter parallel plate 222 is spaced apart from the elongated flat plate 224 and is supported relative to the elongated flat plate 224 by connecting plates 226 extending between the shorter parallel plate 222 and the elongated flat plate 224 on either side of the shorter parallel plate 222. The shorter parallel plate 222 is used to connect the solenoid plunger 202 to the locking member 216. The short parallel plate 222 has a hole 204 extending through it. The solenoid plunger or shaft 202 has a slot 206 at its end. Holes 208 pass through the end of the solenoid plunger 202 on either side of the slot 206. The short parallel plate 222 fits in the slot 206 with the holes 208 aligned with the hole 204. A pin 201 of the slotted spring pin type is pushed into the holes 208 and 204 to connect the locking member 216 to the solenoid plunger 202.

The locking member 216 is supported by the housing 212 for rectilinear movement back and forth in the direction of the longitudinal axis of the locking member 216. The solenoid 218 has a spring 288 that biases the solenoid plunger 202 toward the extended position such that the locking member 216 is biased toward engagement with the pawl 214 when the solenoid 218 is not energized. As an alternative, the spring 288 may be provided intermediate the locking member 216 and the body 290 of the solenoid 218. The spring 288 biases the locking member 216 into the extended position. When the locking member 216 is in the extended position and the pawl 214 is in the closed or latched position, the locking member 216 is positioned behind the lug 254 and prevents the pawl 214 from rotating to the open or unlatched position.

Suitable mounting means are provided to retain the latch assembly 200 on a panel or mounting surface. For example, installation of the latch assembly 200 to a panel may be accomplished with screws or pins that engage the holes 294 and 296 for fastening of the latch assembly 200 to a panel, such as for example, the doorframe of a glove box.

The latch assembly 200 is actuated by energizing the solenoid 218. The solenoid 218 may be energized using a remotely located switch (discussed later). When the solenoid 218 is energized, the locking member 216 is retracted such that the locking member 216 is moved out of engagement with the projection or lug 254 thereby freeing up the pawl 214 for rotation. The bias provided by the pawl torsion spring 260 rotates the pawl 214 from its latched position, where the keeper 228 is captured by the pawl slot 256, and allows the pawl 214 to rotate in the clockwise direction as viewed in FIGS. 11 and 12 toward the unlatched configuration illustrated in FIG. 12. The rotation of the pawl 214 brings the opening of the pawl slot 256 into alignment with the path followed by the Keeper 228 as it moves between the open and closed positions relative to the latch assembly 200. Accordingly, the path of the keeper member 228 from the closed position to the open position is no longer blocked by the side 203 of the pawl slot 256. This allows the keeper member 228 to be disengaged from the pawl 214. Assuming the keeper member 228 is mounted to the door of a glove box and the latch assembly 200 is mounted to the doorframe of the glove box, the door of the glove box can then be opened by swinging the door to the open position. The door being hinged means that the keeper member is confined to traversing the same well defined path as the door is moved between the open and closed positions. The keeper member or striker 228 may be a rod supported at each end by suitable means such as posts attached to the glove box door. In addition, the keeper 228 may be in the form of any other suitable member such as a bar, claw, or other suitable attachment member.

When the glove box door is in the open position and if the solenoid 218 is not energized, as would be the usual case at this time, the locking member 216 is brought to rest against the outer curved pawl profile 207 of the lug 254 and/or the pawl body 252 due to the bias provided by the spring 288, and the locking member 216 is ready for engagement with the flat surface 278 of the lug 254 once the impact of the keeper member 228 rotates the pawl 214 to the latched position as the glove box door is closed. When the door of the glove box is being closed, the opening of the pawl slot 256 faces toward the keeper 228 and the path of the keeper 228 toward engagement with the pawl slot 256 is unobstructed. As the glove box door is slammed shut, the keeper 228 is received in the slot 256 and impacts the pawl 214 on the side 205 of the pawl slot 256 causing the counterclockwise rotation of the pawl 214 to the closed configuration shown in FIG. 11. Once the pawl 214 is driven to the latched position by the keeper 228, the path of the keeper member 228 out of the closed position and toward the open position is once again blocked by the side 203 of the pawl slot 256 such that the keeper 228 is captured by the pawl slot 256. Simultaneously, as the pawl 214 rotates to the latched position, the lug 254 clears the locking member 216 allowing the locking member 216 to move to the extended position under the bias of spring 288 and move behind the lug 254. Once the locking member 216 is in the extended position it catches the flat side 278 of the projection 254 to keep the pawl 214 in the closed position illustrated in FIG. 11, thus securing the glove box door in the closed position through the keeper 228 being captured by the pawl 214.

Referring to FIGS. 38-80, the latch assembly 300 that is illustrative of the second embodiment of the present invention can be seen. The latch assembly 300 includes a latch housing 312, a pawl 314, a locking member 316, and an actuating mechanism 310. The latch housing 312, the pawl 314, the locking member 316, the pawl torsion spring 360, and the locking member biasing spring 388 together form the latch subassembly 309. The actuating mechanism 310 provides means for selectively moving the locking member 316 out of engagement with the pawl 314. In the illustrated embodiment, a linear actuator 318 serves as part of the actuating mechanism 310, which in the illustrated example is electrically powered.

The latch assembly 300 may, for example, be used for securing the door or lid of an automotive glove box (not shown) in the closed position. However, the latch assembly 300 has numerous other applications. The latch assembly 300 can be mounted to either the door or the doorframe depending upon the particular application.

In addition, the latch assembly 300 may be mounted in any orientation depending upon the particular application. Some examples of the environments in which the latch assemblies of the present invention may be used can be seen in U.S. Pat. No. 5,927,772, issued on Jul. 27, 1999 and U.S. Patent Application Publication Number US 2003/0025339 A1, published on Feb. 6, 2003, both of which are incorporated herein by reference in their entirety.

The latch assembly 300 includes a pawl 314 shown pivotally connected to the latch housing 312 with suitable attachment means such as the pawl pivot members or spindles 342, 344 which are provided extending outwardly from the pawl 314 at opposite sides thereof. The pivot members 342, 344 can also be provided as a single pivot member extending through the pawl 314. A pair of larger diameter base portions 346 are provided at the base of the pawl pivot members 342, 344. Portions 332 of the housing 312 extend on either side of the pawl 314 such that they define a slot 338. At least a portion of the pawl 314 is received or positioned within the slot 338. The base portions 346 prevent excessive lateral play of the pawl 314 once the pawl is installed to the housing 312 while maintaining sufficient clearance between the sides of the pawl 314 and the portions 332 of the housing 312 to accommodate the coiled portions of the pawl torsion spring 360.

The portions 332 of the housing 312 continue extending on either side of the pawl 314 away from the axis of rotation of the pawl 314 until they meet an overhanging portion 334. The overhanging portion 334 juts outward from the portions 332 and overhangs at least a portion of the pawl 314. The portions 332 are at least in part set back relative to the pawl slot 356 when the pawl 314 is in the latched position, such that the portions 332 do not overlap the portion of the pawl slot where the keeper member 328 is located. Thus, the portions 332 will not interfere with the movement of the keeper member 328 relative to the pawl 314 to the closed or latched position. Unlike the latch assembly 200, the actuating mechanism 310 has its own separate housing referred to as the actuator mechanism housing 311. The actuating mechanism housing 311 has a base plate 313 for supporting the linear actuator 318. The separate actuator mechanism housing 311 allows the actuating mechanism to be located remotely from the latch subassembly 309 to thereby reduce the severity of the size limitations on the linear actuator 318 that can be used with the latch assembly 300. The actuating mechanism 310 includes a Bowden cable 315 that links the linear actuator 318 with the locking member 316. The latch housing 312 also has a base plate 340 adapted to support one end of the Bowden cable covering 317 and to support the locking member 316 for rectilinear back and forth motion.

The pawl 314 is installed onto the housing 312 by snap-fit placement of the pawl pivot members 342, 344 into the pawl pivot recesses 348 disposed in the respective housing portions 332 on opposite sides of the slot 338. A pair of guide slots 350 are provided in the respective housing portions 332 on either side of the slot 338 which lead to the recesses 348. The pair of guide slots 350 form ramped surfaces which spread farther apart from one another with increasing distance from the recesses 348. The guide slots 350 guide the pawl pivot members 342, 344 in the direction of the pawl pivot recesses 348 during the snap-fitting process.

As shown in FIGS. 48, 49, and 74-80, the pawl 314 has a body portion 352. The pair of pawl pivot members 342, 344 project from either side of the pawl body portion 352. The pawl 314 has a lug or projection 354 and is provided with a pawl slot 356 to retain the keeper member 328 when the pawl 314 is in the latched position. The keeper member 328 is, for example, attached to the lid of a glove box at a position such that when the swinging lid or door of the glove box is closed, the keeper member 328 will be positioned and captured in the pawl slot 356 with the pawl 314 in the latched position illustrated in FIGS. 38-45 and 48. The pawl 314 is also provided with an arm portion 358 extending from the pawl body 352.

The pawl torsion spring 360 is installed on the pawl 314 with the coiled portions 362 and 364 surrounding the base portions 346 of the pawl pivot members 342 and 344, respectively. The cross bar 366 of the torsion spring 360 engages a surface 336 that is a radial distance away from the axis of rotation of the pawl 314 such that the pawl torsion spring 360 imparts a torque to the pawl 314 that biases the pawl 314 toward the unlatched position. In the illustrated example, the surface 336 is provided in the notch 368 near the tip of the arm portion 358. The torsion spring 360 also has tail portions 370, 372 and arms 374, 376. The vertical spring arms 374, 376 extend from the respective coil portions 362 and 364 of the torsion spring 360 and connect to cross bar 366. The pawl arm 358 is positioned intermediate the spring arms 374 and 376. The pawl 314 is installed in the housing 312 from the side of the housing portions 332 opposite the side from which the overhanging portion 334 projects. The projection or lug 354 has a flat surface 378 that extends roughly in a radial direction relative to the axis rotation of the pawl 314.

The tails 370, 372 of the torsion spring 360 fit into and lie along the grooves 380, 382, respectively, when the pawl 314 is snap-fitted to the housing 312. With the tails 370, 372 of the torsion spring 360 so positioned, the cross bar 366 of the torsion spring 360 exerts a force on the arm portion 358 of the pawl 314 that biases the pawl 314 toward the open or unlatched configuration.

The linear actuator 318 is supported on the base plate 313 and is held in position by a resilient arm 384 that has a catch tooth or barb 320 at its tip. The catch tooth or barb 320 has a saw tooth profile. Each end of the cable cover 317 is provided with a pair of spaced apart annular flanges 319, 321. The actuating mechanism housing 311 further includes a pair catch arms 323 and a fin 325 having an arcuate cutout. The catch arms 323 snap around the cable cover 317 near the end of the cable cover proximate the actuating mechanism housing 311 and the fin 325 fits between the pair of annular flanges 319 to thereby cooperatively fix one end of the cable cover 317 to the actuating mechanism housing 311. The locking member 316 is in the form of an elongated flat plate 324 that has a receptacle 322 provided on one side of the elongated flat plate 324 near the end that is farthest from the pawl 314. The receptacle 322 is dimensioned and configured to receive the dowel 327 fixed in a "T" configuration to the end of the cable 315 proximate the latch housing 312. The receptacle 322 has an opening for receiving the dowel 327 that faces toward the tip portion 329 of the locking member 316 that engages the pawl 314. A slot 326 cuts through the receptacle 322 such that once the dowel 327 is positioned in the receptacle 322 the cable 315 can extend through the slot 326 in a direction diametrically away from the tip portion 329 of the locking member 316. Thus, one end of the cable 315 is connected to the locking member 316. The latch housing 312 further includes a pair catch arms 330 and a fin 331 having an arcuate cutout. The catch arms 330 snap around the cable cover 317 near the end of the cable cover proximate the latch housing 312 and the fin 331 fits between the pair of annular flanges 321 to thereby cooperatively fix one end of the cable cover 317 to the latch housing 312. The cable 315 extends from the receptacle 322 into the cable cover or sheath 317 through the end of the cover 317 that is fixed to the latch housing 312.

The linear actuator plunger or shaft 302 has a receptacle 306 provided at its end. The receptacle 306 is dimensioned and configured to receive the dowel 301 fixed in a "T" configuration to the end of the cable 315 proximate the actuating mechanism housing 311. The receptacle 306 has an opening for receiving the dowel 301 that faces to one side of the linear actuator plunger or shaft 302. A slot 308 cuts through the receptacle 306 such that once the dowel 301 is positioned in the receptacle 306 the cable 315 can extend through the slot 308 in a direction coincident with the longitudinal axis of the linear actuator plunger 302 away from the tip portion 304 of the linear actuator plunger 302. Thus, the other end of the cable 315 is connected to the linear actuator plunger or shaft 302. Accordingly, the cable 315 connects the locking member 316 to the linear actuator plunger 302. The cable 315 extends from the receptacle 306 into the cable cover or sheath 317 through the end of the cover 317 that is fixed to the actuating mechanism housing 311.

The locking member 316 is supported by the housing 312 for rectilinear movement back and forth in the direction of the longitudinal axis of the locking member 316. The coil spring 388 biases the locking member 316 toward the extended position such that the locking member 316 is biased toward engagement with the pawl 314 when the linear actuator 318 is not energized. The spring 388 acts between the locking member 316 and the latch housing 312. When the locking member 316 is in the extended position and the pawl 314 is in the closed or latched position, the locking member 316 is positioned behind the lug 354 and prevents the pawl 314 from rotating to the open or unlatched position.

Suitable mounting means are provided to retain the latch subassembly 309 on a panel or mounting surface. For example, installation of the latch subassembly 309 to a panel may be accomplished with screws or pins that engage the holes 394 for fastening of the latch subassembly 309 to a panel, such as for example, the doorframe of a glove box. Any known means may be used to mount the actuating mechanism housing 311 to a location, for example, on the automobile's instrument panel or on the doorframe of the glove box remote from the latch subassembly 309. The means selected for mounting the actuating mechanism housing 311 is not critical to the present invention.

The latch assembly 300 is actuated by energizing the linear actuator 318. The linear actuator 318 may be energized using a remotely located switch (discussed later). The linear actuator 318 is of the type that uses a rotating screw to linearly displace the plunger 308. The linear actuator 318 uses a rotary electric motor to impart rotation to the screw. When the linear actuator 318 is energized, the linear actuator plunger 302 is moved to the retracted position. This action causes the fixed length cable 315 to be pulled, which in turn retracts the locking member 316 such that the locking member 316 is moved out of engagement with the projection or lug 354 thereby freeing up the pawl 314 for rotation. The bias provided by the pawl torsion spring 360 rotates the pawl 314 from its latched position, where the keeper 328 is captured by the pawl slot 356, and allows the pawl 314 to rotate in the counterclockwise direction as viewed in FIGS. 48 and 49 toward the unlatched configuration illustrated in FIG. 49. The rotation of the pawl 314 brings the opening of the pawl slot 356 into alignment with the path followed by the Keeper 328 as it moves between the open and closed positions relative to the latch subassembly 309. Accordingly, the path of the keeper member 328 from the closed position to the open position is no longer blocked by the side 303 of the pawl slot 356. This allows the keeper member 328 to be disengaged from the pawl 314. Assuming the keeper member 328 is mounted to the door of a glove box and the latch subassembly 309 is mounted to the doorframe of the glove box, the door of the glove box can then be opened by swinging the door to the open position. The door being hinged means that the keeper member is confined to traversing the same well defined path as the door is moved between the open and closed positions. The keeper member or striker 328 may be a rod supported at each end by suitable means such as posts attached to the glove box door. In addition, the keeper 328 may be in the form of any other suitable member such as a bar, claw, or other suitable attachment member.

When the glove box door is in the open position and if the linear actuator 318 is not energized, as would be the usual case at this time, the locking member 316 is brought to rest against the outer curved pawl profile 307 of the lug 354 and/or the pawl body 352 due to the bias provided by the spring 388, and the locking member 316 is ready for engagement with the flat surface 378 of the lug 354 once the impact of the keeper member 328 rotates the pawl 314 to the latched position as the glove box door is closed. When the door of the glove box is being closed, the opening of the pawl slot 356 faces toward the keeper 328 and the path of the keeper 328 toward engagement with the pawl slot 356 is unobstructed. As the glove box door is slammed shut, the keeper 328 is received in the slot 356 and impacts the pawl 314 on the side 305 of the pawl slot 356 causing the clockwise rotation of the pawl 314 to the closed configuration shown in FIG. 48. Once the pawl 314 is driven to the latched position by the keeper 328, the path of the keeper member 328 out of the closed position and toward the open position is once again blocked by the side 303 of the pawl slot 356 such that the keeper 328 is captured by the pawl slot 356. Simultaneously, as the pawl 314 rotates to the latched position, the lug 354 clears the locking member 316 allowing the locking member 316 to move to the extended position under the bias of spring 388 and move behind the lug 354. Once the locking member 316 is in the extended position it catches the flat side 378 of the projection 354 to keep the pawl 314 in the closed position illustrated in FIG. 48, thus securing the glove box door in the closed position through the keeper 328 being captured by the pawl 314. The bias provided by the spring 388 also resets the linear actuator plunger 302 to the extended position via the cable 315.

Figure 81:
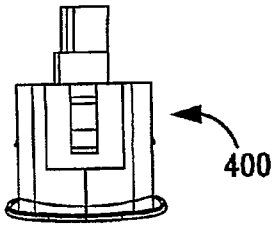
Figure 98:
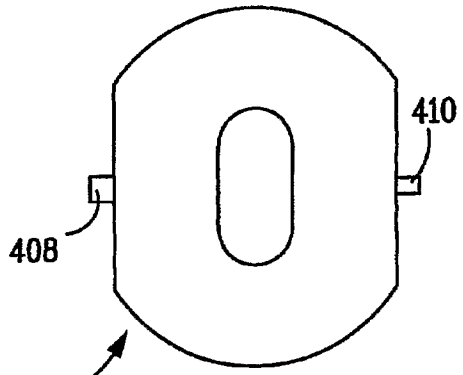
FIGS. 95-101 are views of the back plate of the rocker switch button of a rocker switch assembly in accordance with the present invention.
Figure 97:
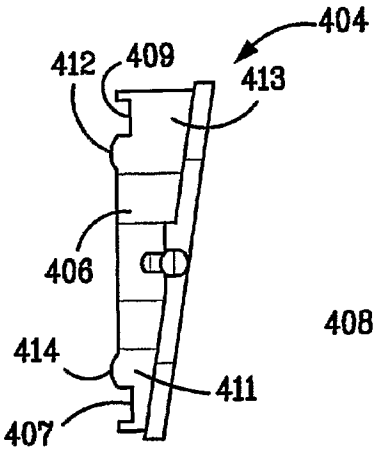
Figure 96:
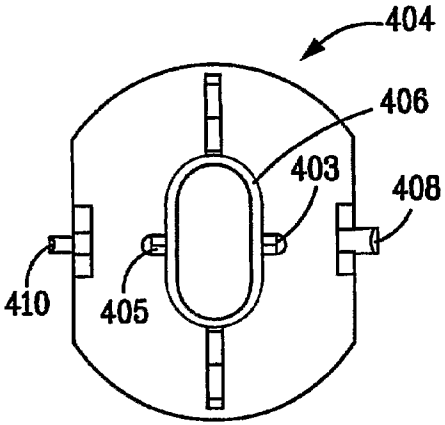
Figure 95:
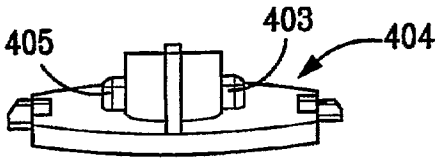
Figure 101:
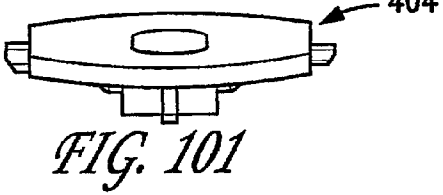
Figure 100:
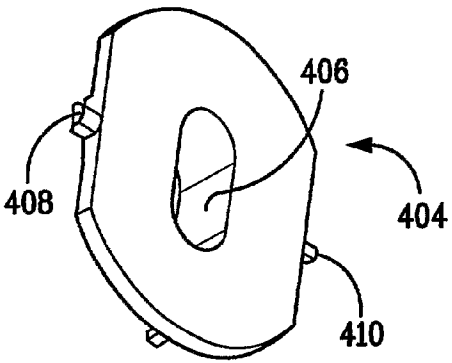
Figure 99:
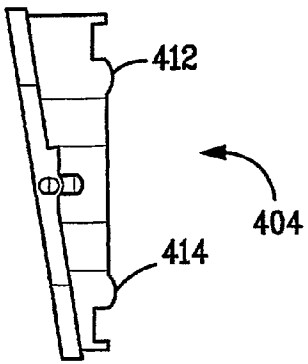
Figure 102:
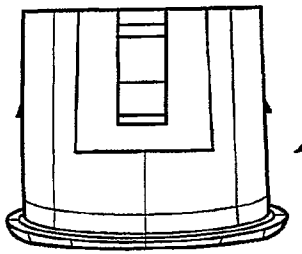
FIGS. 102-108 are views of the outer housing of a rocker switch assembly in accordance with the present invention.
Figure 103:
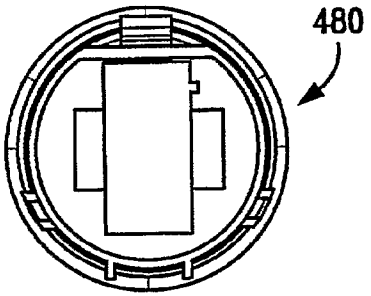
Figure 104:
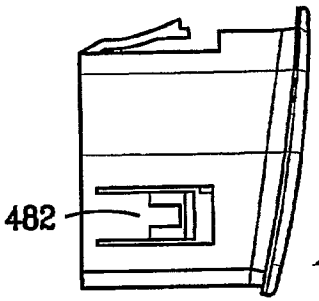
Figure 105:
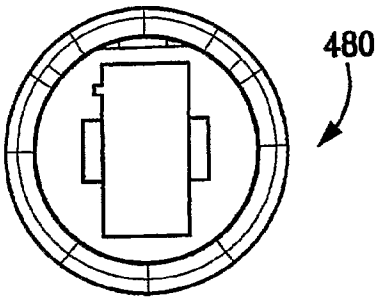
Figure 106:
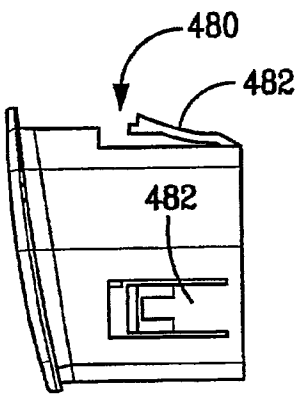
Figure 107:
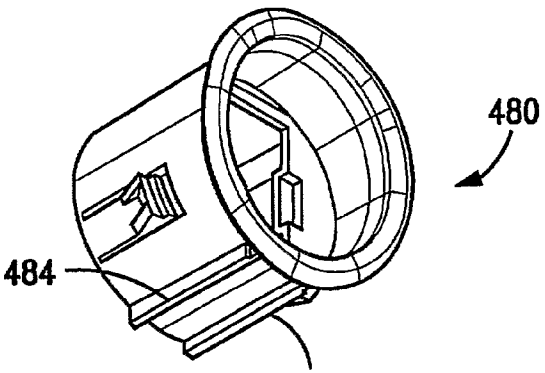
Figure 108:
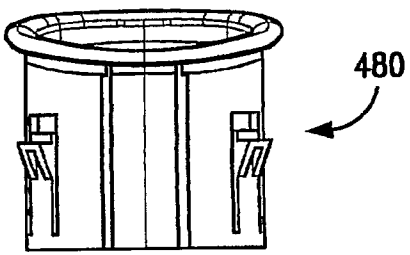
Figure 119:
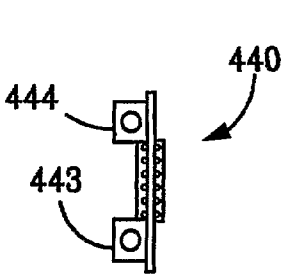
FIGS. 116-122 are views of the printed circuit board of a rocker switch assembly in accordance with the present invention.
Figure 118:
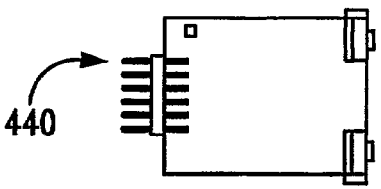
Figure 117:
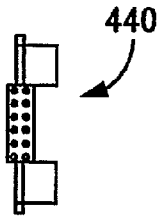
Figure 116:
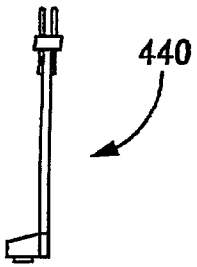
Figure 122:
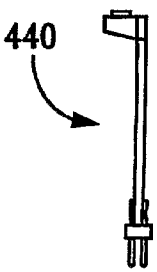
Figure 121:
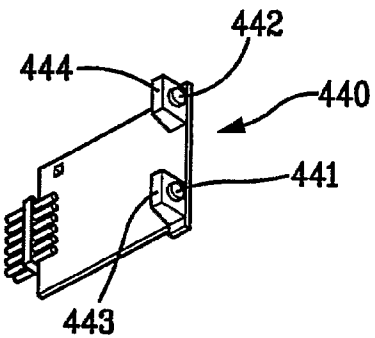
Figure 120:
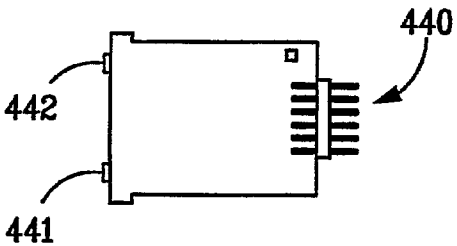
Figure 126:
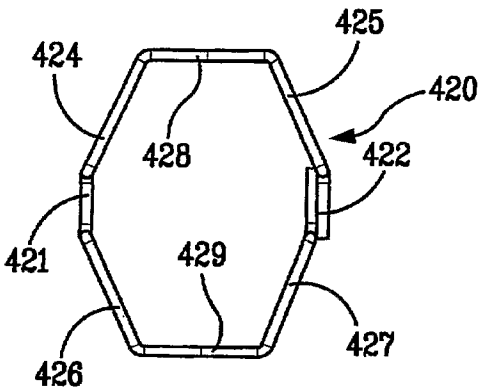
FIGS. 123-129 are views of the biasing spring for biasing the rocker switch button of a rocker switch assembly in accordance with the present invention.
Figure 129:
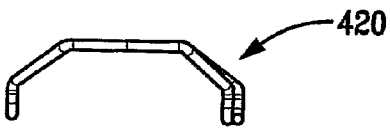
Figure 125:
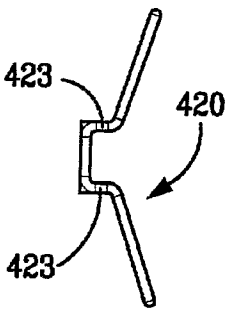
Figure 128:
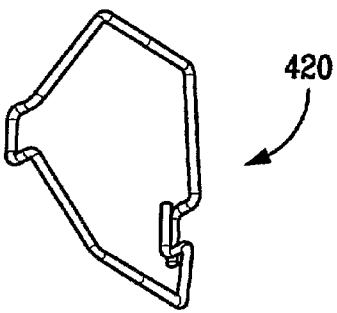
Figure 124:
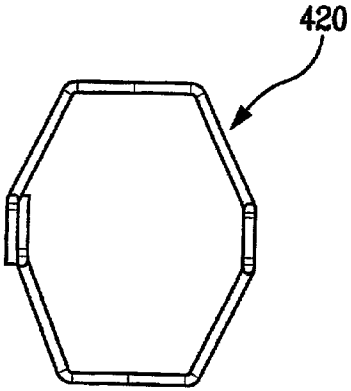
Figure 127:
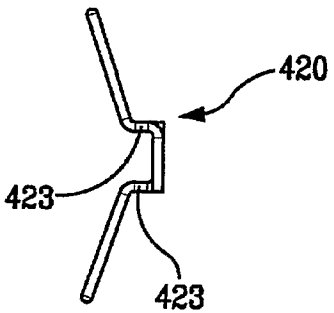
Figure 123:
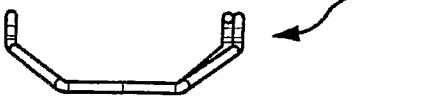
Figure 130:
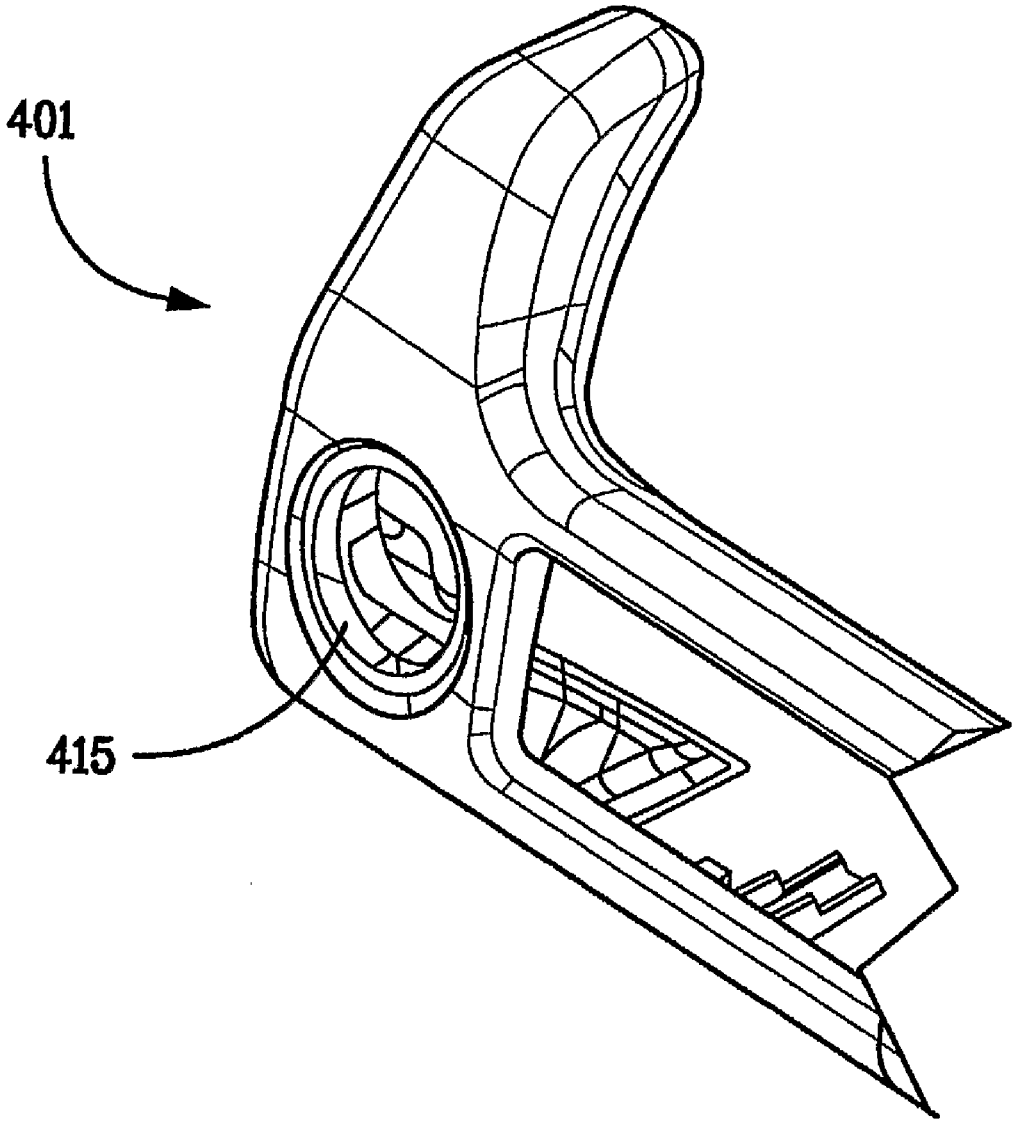
FIG. 130 is an isometric view of a portion of the instrument panel of an automobile adapted to receive the rocker switch assembly in accordance with the present invention.
Figure 131:
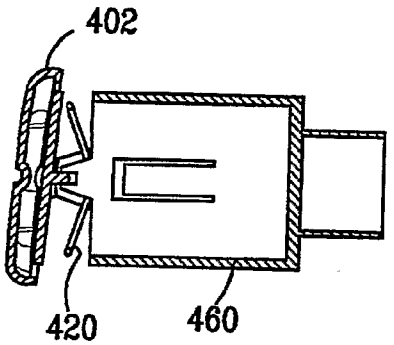
FIG. 131 is a cross sectional view of a subassembly, including the inner housing, the printed circuit board, the spring, and the rocker switch button, of a rocker switch assembly in accordance with the present invention showing the subassembly sectioned longitudinally offset relative to the center line.
Figure 132:
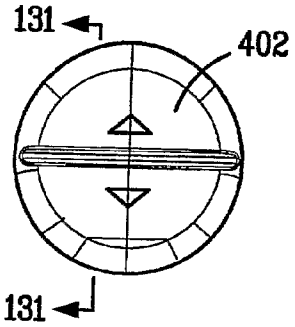
FIG. 132 is a view of a subassembly, including the inner housing, the printed circuit board, the spring, and the rocker switch button, of a rocker switch assembly in accordance with the present invention showing the section line corresponding to the cross sectional view of FIG. 131.
Figure 133:
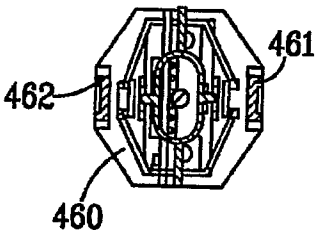
FIG. 133 is a cross sectional view of a subassembly, including the inner housing, the printed circuit board, the spring, and the rocker switch button, of a rocker switch assembly in accordance with the present invention showing the subassembly sectioned transversely.
Figure 134:
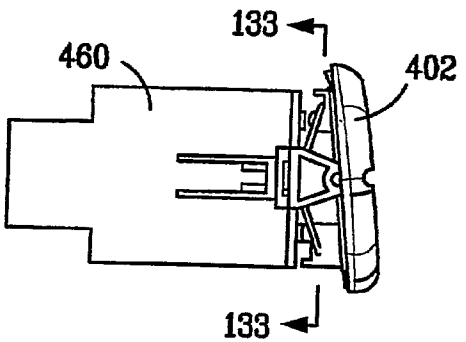
FIG. 134 is a view of a subassembly, including the inner housing, the printed circuit board, the spring, and the rocker switch button, of a rocker switch assembly in accordance with the present invention showing the section line corresponding to the cross sectional view of FIG. 133.
Figure 135:
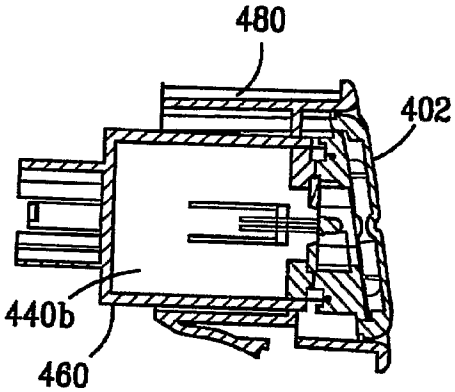
FIG. 135 is a cross sectional view of the rocker switch assembly in accordance with the present invention showing the rocker switch assembly sectioned longitudinally along the center line.
Figure 136:
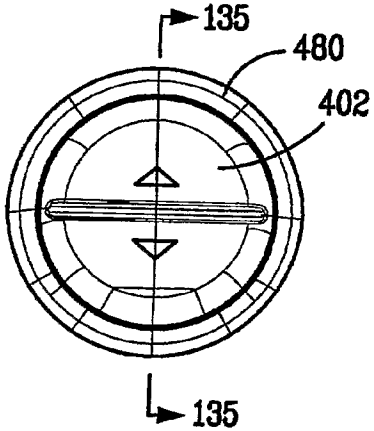
FIG. 136 is a view of the rocker switch assembly in accordance with the present invention showing the section line corresponding to the cross sectional view of FIG. 135.
Figure 139:
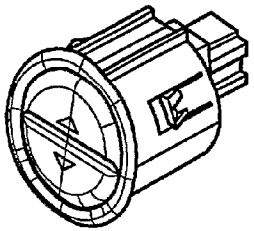
FIGS. 137-139 are views of the rocker switch assembly in accordance with the present invention showing the lower side of the rocker switch button depressed.
Figure 142:
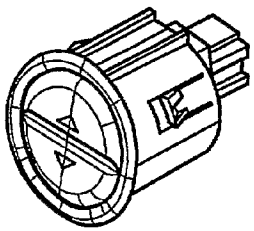
FIGS. 140-142 are views of the rocker switch assembly in accordance with the present invention showing the rocker switch button in the normal position.
Figure 145:
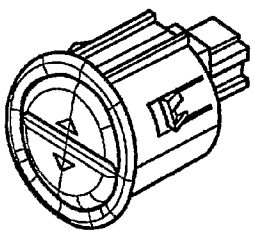
FIGS. 143-145 are views of the rocker switch assembly in accordance with the present invention showing the upper side of the rocker switch button depressed.
Figure 138:
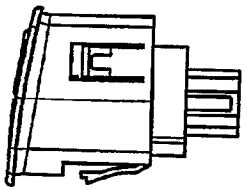
Figure 141:
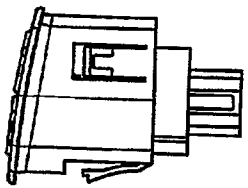
Figure 144:
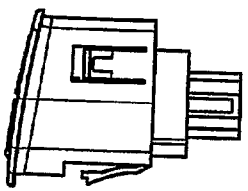
Figure 137:
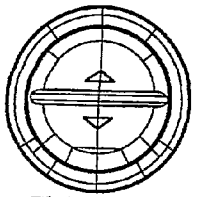
Figure 140:
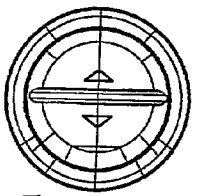
Figure 143:
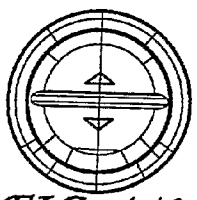
Figure 146:
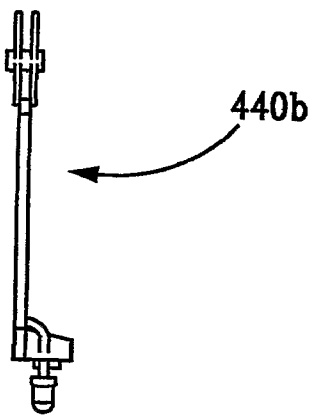
FIGS. 146-149 are views of an alternative printed circuit board with a light source for use with the rocker switch assembly in accordance with the present invention.
Figure 147:
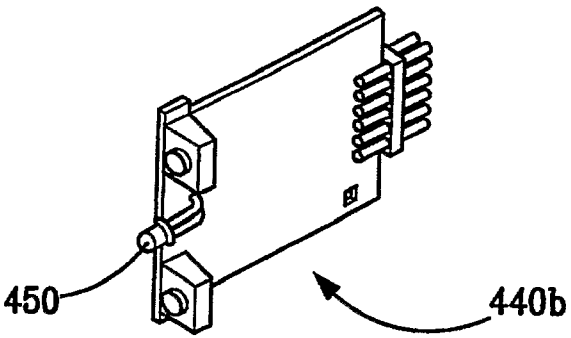
Figure 148:
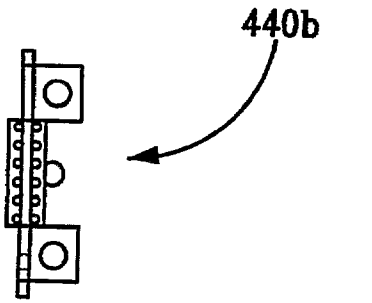
Figure 149:
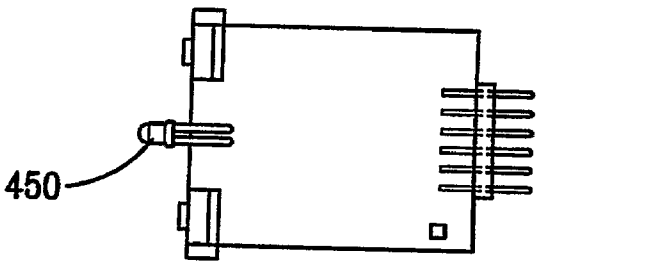
Figure 150:
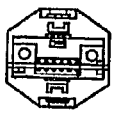
FIGS. 150-167 are views showing the assembly sequence of the rocker switch assembly in accordance with the present invention.
Figure 151:
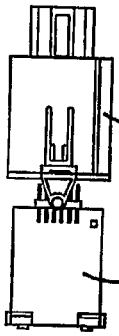
Figure 152:
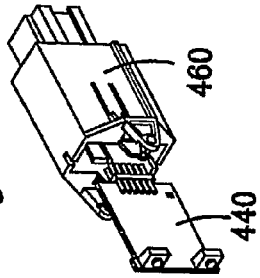
Figure 153:
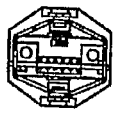
Figure 154:
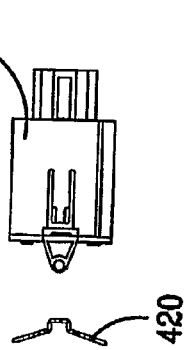
Figure 155:
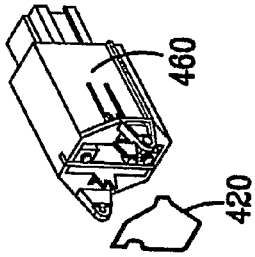
Figure 156:
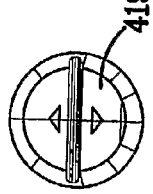
Figure 157:
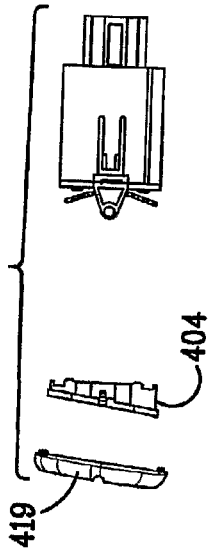
Figure 158:
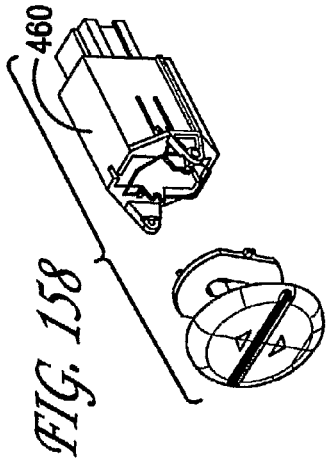
Figure 160:
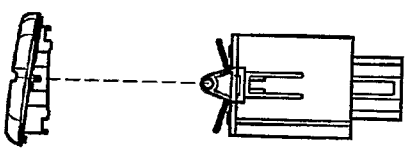
Figure 159:
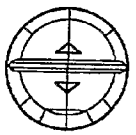
Figure 163:
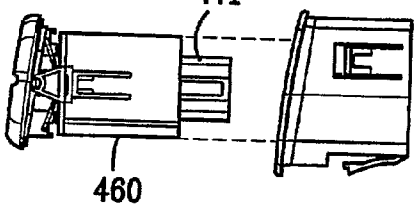
Figure 162:
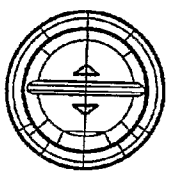
Figure 166:
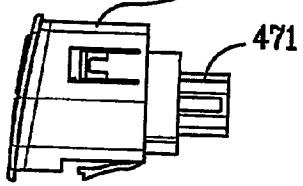
Figure 165:
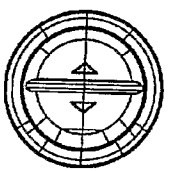
Figure 161:
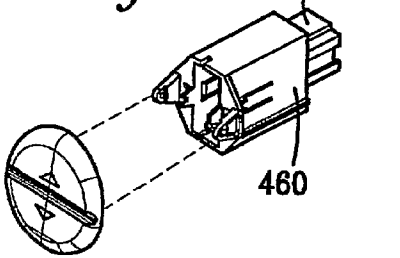
Figure 164:
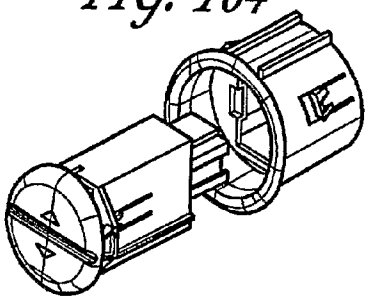
Figure 167:
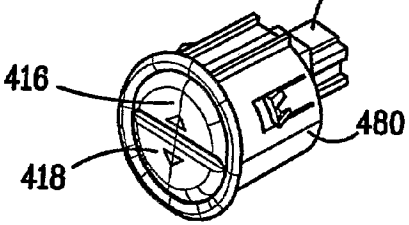

Referring to FIGS. 81-167 a rocker switch 400 suitable for serving as a user interface to allow a user to operate or initiate actuation of the latch assemblies 200 and 300 can be see. The rocker switch 400 is of general applicability and may also be employed in, for example, operating power windows or door locks in an automobile.

FIGS. 81-87 are views of the rocker switch assembly 400 in accordance with the present invention. The rocker switch 400 includes a button 402, biasing spring 420, printed circuit board (PCB) 440, inner housing 460, and outer housing 480. In the illustrated example, the button 402 is made of two pieces, the two pieces being the faceplate 419 of the rocker switch button 402 and the back plate 404 of the rocker switch button 402. FIGS. 88-94 illustrate the faceplate 419 of the rocker switch button 402. FIGS. 95-101 illustrate the back plate 404 of the rocker switch button 402. The button 402 may alternatively be made in one piece. The button 402, and in particular the back plate 404, has an enclosed wall 406 projecting outward from the backside thereof. The area enclosed by the enclosed wall 406 is open, i.e. is in the form of an opening to allow backlighting to reach the faceplate 419. The faceplate 419 is attached to the back plate 404 by, for example, a snap-fit arrangement or by using adhesives. The back plate 404 also has two lateral projections 408, 410 that provide for the pivotal attachment of the button 402 to the inner housing 460. The pivot axis of the button 402 extends through approximately the middle of the button 402 when viewed in plan view such that the button 402 is pivotally movable in seesaw fashion by pressing the button 402 on either side of its centerline. The back plate 404 also has protuberances 412 and 414 projecting from the backside thereof on either side of the pivot axis of the button 402. Each of the protuberances 412, 414 register with the pressure pad 441, 442 of a respective microswitch 443, 444. Pressing the button 402 on either side of its centerline pivot axis activates a respective microswitch 443, 444 by causing the pressure pad of the respective microswitch to be depressed and thereby close a contact within the microswitch.

FIGS. 116-122 are views of the printed circuit board 440 of the rocker switch assembly 400. The micro-switches 443, 444 are supported by the substrate of the PCB 440. The PCB 440 may also include electronic circuitry for providing a signal in response to the activation of one or the other of the micro-switches 443, 444 in the manner required by the particular application. The details of the electronic circuitry vary with application and are generally well known and will not be discussed here.

FIGS. 109-115 show the inner housing 460 of the rocker switch assembly 400. The PCB 440 is received in the inner housing 460. The inner housing 460 has a pair of outer projecting fins 461, 462 and a pair of inner projecting fins 463, 464. Each of the pair of outer projecting fins 461, 462 is provided with a journal bearing 465, 466. The pair of outer projecting fins 461, 462 are made from resilient material such that lateral projections 408, 410 can snap into the journal bearings 465, 466, respectively in order to pivotally attach the button 402 to the inner housing 460.

The back plate 404 has a pair of ribs 403, 405. The ribs 403, 405 are provided on either side of the enclosed wall 406 in line with the pivot axis of the button 402. Each rib 403, 405 is received in a respective groove 467, 468 formed in a respective one of the pair of inner projecting fins 463, 464, when the button 402 is in the normal position where neither one of the micro-switches 443, 444 is activated. Any attempt to depress one side of the button 402 will cause the ribs 403, 405 to become misaligned relative to their respective grooves 467, 468. Accordingly, the ribs 403, 405 have to force the pair of inner projecting fins 463, 464 apart in order for pivotal movement of the button 402 to take place. Although the pair of inner projecting fins 463, 464 are made of resilient material so that pivotal movement of the button 402 can take place, nevertheless, they provide resistance to the pivotal movement of the button 402, and thus provide a detent mechanism that tends to maintain the button 402 in the normal position. In addition, the interaction of the sloping sides of the grooves 467, 468 with the misaligned ribs 403, 405 provides a biasing force that tends to restore the button 402 to the normal position.

FIGS. 123-129 show the biasing spring 420 for biasing the rocker switch button 402 toward the normal position. The spring 420 has two straight portions 421, 422 that fit under tabs 469, 470 of the inner housing 460 to mount the spring 420 to the inner housing 460. A step portion 423 at either end of the two straight portions 421, 422, allows the spring 420 to extend outward from the inner housing 460. Sloping spring arms 424, 425, 426, and 427 extend from the step portions 423. The sloping spring arms 424, 425 are joined at their outer ends by the crossbar 428, and the sloping spring arms 426, 427 are joined at their outer ends by the crossbar 429. The crossbars 428, 429 press against bearing surfaces 407, 409, respectively, provided by the fins 411, 413 projecting from the backside of the back plate 404 to bias the button 402 toward the normal position. The fins 411, 413 also support the protuberances 412, 414, respectively.

The Rocker switch 400 is mounted on the centre console area of the Instrument Panel 401 and is intended for use as an activation device to be used with glove boxes having two doors, with each door being secured by a corresponding latch assembly such as the latch assemblies 200 or 300 for, for example, opening doors to two individual glove box storage areas.

The Rocker Switch 400 is connected to the vehicle's electrical wiring loom. The glove box latches 200 or 300 would also be connected to the vehicle's wiring loom.

To provide power to, e.g., the upper glove box latch 200 or 300 in order to release the latching mechanism and open the corresponding door, the top half 416 of the rocker switch button 402 is simply pressed into the housing by the user. In the illustrated example, the rocker switch 400 is mounted in an orientation such that the pivot axis of the button 402 is about horizontal, and up and down arrow indicia are provided on the surface of the upper half 416 and the lower half 418 of the button 402. The rocking motion of the button 402 causes the upper protuberance 412 to make contact with the upper micro-switch 443 mounted on the PCB 440 and the corresponding circuit is completed. Thus a solenoid or linear actuator of a respective latch assembly 200 or 300 is energized for a timed duration to achieve unlatching of the respective latch assembly.

Upon the user releasing pressure on the rocker switch button 402, the rocker switch button 402 will rotate back to the normal position, where neither micro-switch 443 or 444 is pressed, under bias of the internal spring 420.

To provide power to the other, e.g. lower glove box latch 200 or 300, the lower half 418 of the rocker switch button 402 is pressed causing the lower protuberance 414 to make contact with the lower micro-switch 444 mounted on the PCB 440 and the corresponding circuit is completed. Thus a solenoid or linear actuator of a respective latch assembly 200 or 300 is energized for a timed duration to achieve unlatching of the respective (e.g. lower) latch assembly.

Again, upon the user releasing pressure on the rocker switch button 402, the rocker switch button 402 will rotate back to the normal position, where neither micro-switch 443 or 444 is pressed, under bias of the internal spring 420.

The rocker switch button 402 is held in the normal position by means of the spring 420 and additionally the detent feature provided by the grooves 467, 468 and the ribs 403, 405. When the button 402 is pressed (i.e. rocked) the ribs will reluctantly travel out of their set detent position. Aided by the spring 420 when the button 402 is released the ribs will automatically tend to return to their detent positions, i.e. returning the button 402 to the normal position.

The rocker switch 400 is attached to the vehicle wiring loom using a moulded in connector shroud 471 (moulded into the inner housing 460) with male header pins 445 (mounted on PCB 440). The female mating half for the connector forms part of the vehicle wiring loom.

Once the rocker switch 400 is connected to the wiring loom it is then assembled into the centre instrument panel 401. This is achieved by pushing the switch assembly through a circular opening 415 in the panel 401. Three snap legs 482 on the outer switch housing 480 secure the switch 400 to the panel 401. Incorrect assembly orientation into the panel is prevented through the use of locating ribs 484 in the housing 480 which match a 'keyway' in the panel 401. Snap legs 472 on the inner switch housing 460 secure the inner switch housing 460 to the outer switch housing 480.

The switch 400 can be installed in both right-hand drive and left-hand drive vehicles without modification. The PCB 440*b* is modified to allow for an illumination option. A light emitting diode (LED) 450 (or two) can be added to the PCB to allow for illumination of the Rocker Switch button indicia.

It will be apparent to those skilled in the art that various modifications can be made to the latch of the present invention without departing from the scope and spirit of the invention, and it is intended that the present invention cover modifications and variations of the latch which are within the scope of the appended claims and their equivalents.

The invention claimed is:

1. A rocker switch suitable for serving as a user interface to allow a user to actuate at least one electrically powered device, the rocker switch comprising:

an outer housing adapted for mounting to a console;

an inner housing received at least in part in said outer housing, said inner housing having a pair of inner projecting fins;

a printed circuit board supported by said inner housing;

a button pivotally supported by said inner housing, said button being pivotally movable about a pivot axis that extends through approximately the centerline of said button when viewed in plan view such that said button is pivotally movable in seesaw fashion by pressing said button on either side of said centerline of said button, said button having a back plate, said back plate having a pair of ribs provided on a backside of said back plate below said pivot axis, each of said ribs being received in a respective groove formed in a respective one of said pair of inner projecting fins when said button is in said neutral position;

a first micro switch supported by said printed circuit board at a location such that, when said button is moved to a first position corresponding to said button being pivotally moved by being pressed on a first side of said centerline of said button, then said first micro switch is actuated by said button;

a second micro switch supported by said printed circuit board at a location such that, when said button is moved to a second position corresponding to said button being pivotally moved by being pressed on a second side of said centerline of said button, then said second micro switch is actuated by said button; and a biasing spring acting between said button and said inner housing, said spring biasing said button toward a neutral position where neither said first micro switch nor said second micro switch is actuated, wherein any movement of said button toward one of said first and second positions will cause said ribs to become misaligned relative to their respective grooves and said pair of inner projecting fins have to be forced apart by said ribs in order for pivotal movement of said button to take place, whereby said ribs provide resistance to the pivotal movement of said button and thus provide a detent mechanism that tends to maintain said button in said neutral position.

2. The rocker switch according to claim 1, wherein said back plate has two lateral projections that provide for the pivotal attachment of said button to said inner housing, said inner housing has a pair of outer projecting fins that are each provided with a journal bearing that received a respective one of said lateral projections in order to pivotally attach said button to said inner housing.

3. The rocker switch according to claim 1, wherein said biasing spring is in the form of a wire loop and has portions in contact with said inner housing, a first portion in contact with said button on a first side of said pivot axis, a second portion in contact with said button on a second side of said pivot axis, first sloping portions extending between said first portion that is in contact with said button on said first side of said pivot axis and said portions in contact with said inner housing, and second sloping portions extending between said second portion that is in contact with said button on said second side of said pivot axis and said portions in contact with said inner housing.

4. The rocker switch according to claim 1, wherein said button is provided with indicia, and wherein the rocker switch further comprises a light emitting diode supported by said printed circuit board to allow for illumination of said button indicia.

5. The rocker switch according to claim 1, wherein said button is provided with a pair of protuberances projecting from a backside of said button on either side of said pivot axis of said button, each of said protuberances register with a respective one of said first and second micro switches, and pressing said button on either side of said pivot axis brings a respective one of said protuberances into contact with a respective one of said first and second micro switches in order to actuate said respective one of said first and second micro switches.

6. A rocker switch suitable for serving as a user interface to allow a user to actuate at least one electrically powered device, the rocker switch comprising:

an outer housing adapted for mounting to a console;

an inner housing received at least in part in said outer housing;

a printed circuit board supported by said inner housing;

a button pivotally supported by said inner housing, said button being pivotally movable about a pivot axis that extends through approximately the centerline of said button when viewed in plan view such that said button is pivotally movable in seesaw fashion by pressing said button on either side of said centerline of said button;

a first micro switch supported by said printed circuit board at a location such that, when said button is moved to a first position corresponding to said button being pivotally moved by being pressed on a first side of said centerline of said button, then said first micro switch is actuated by said button;

a second micro switch supported by said printed circuit board at a location such that, when said button is moved to a second position corresponding to said button being pivotally moved by being pressed on a second side of said centerline of said button, then said second micro switch is actuated by said button; and a biasing spring acting between said button and said inner housing, said spring biasing said button toward a neutral position where neither said first micro switch nor said second micro switch is actuated, wherein said biasing spring is in the form of a wire loop and has portions in contact with said inner housing, a first portion in contact with said button on a first side of said pivot axis, a second portion in contact with said button on a second side of said pivot axis, first sloping portions extending between said first portion that is in contact with said button on said first side of said pivot axis and said portions in contact with said inner housing, and second sloping portions extending between said second portion that is in contact with said button on said second side of said pivot axis and said portions in contact with said inner housing, wherein said button has a back plate that has two lateral projections that provide for the pivotal attachment of said button to said inner housing, said inner housing has a pair of outer projecting fins that are each provided with a journal bearing that received a respective one of said lateral projections in order to pivotally attach said button to said inner housing, wherein said inner housing is provided with a pair of inner projecting fins, wherein said back plate has a pair of ribs, said ribs are provided on a backside of said back plate below said pivot axis, each of said ribs is received in a respective groove formed in a respective one of said pair of inner projecting fins when said button is in said neutral position, and wherein any movement of said button toward one of said first and second positions will cause said ribs to become misaligned relative to their respective grooves and said pair of inner projecting fins have to be forced apart by said ribs in order for pivotal movement of said button to take place, whereby said ribs provide resistance to the pivotal movement of said button and thus provide a detent mechanism that tends to maintain said button in said neutral position.

7. The rocker switch according to claim 6, wherein said button is provided with indicia, and wherein the rocker switch further comprises a light emitting diode supported by said printed circuit board to allow for illumination of said button indicia.

8. The rocker switch according to claim 6, wherein said button is provided with a pair of protuberances projecting from a backside of said button on either side of said pivot axis of said button, each of said protuberances register with a respective one of said first and second micro switches, and pressing said button on either side of said pivot axis brings a respective one of said protuberances into contact with a respective one of said first and second micro switches in order to actuate said respective one of said first and second micro switches.

9. A latch assembly for releasably securing a first member in a closed position relative to a second member, one of said first member and said second member having a keeper in a fixed positional relationship therewith, the latch assembly comprising:

a housing;

a pawl pivotally attached to said housing and being movable between a closed or engaged position and an open or disengaged position, said pawl moving rotationally about an axis of rotation, said pawl being provided with a torsion spring member that biases said pawl toward said open or disengaged position;

a locking member supported by said housing for rectilinear movement, said locking member being movable between extended and retracted positions, said locking member moving rectilinearly between said extended and said retracted positions in a direction perpendicular to said axis of rotation of said pawl; and an electrically powered actuating mechanism for moving said locking member from said extended position to said retracted position; and a rocker switch in accordance with claim 1 or 6 serving as a user interface to allow a user to actuate said electrically powered actuating mechanism, wherein, when said pawl impacts the keeper during closing of the first and second members together, said pawl is moved to said closed position, and wherein when said pawl is in said closed position a lug projecting from said pawl is engaged by said locking member when said locking member is in said extended position to retain said pawl in said closed position, and wherein retracting said locking member by energizing said electrically powered actuating mechanism, allows said pawl to rotate under spring bias to said open position to thereby allow the latch to be disengaged from the keeper.

10. The latch assembly according to claim 9, wherein said electrically powered actuating mechanism is a solenoid supported by said housing.

11. The latch assembly according to claim 9, wherein said electrically powered actuating mechanism is a remotely located linear actuator that is connected to said locking member by a Bowden cable.

12. The latch assembly according to claim 9, wherein said electrically powered actuating mechanism is one of a plurality of electrically powered actuating mechanisms.

* * * * *